US009225055B2

(12) United States Patent
Kaneko

(10) Patent No.: US 9,225,055 B2
(45) Date of Patent: Dec. 29, 2015

(54) ANTENNA DEVICE

(75) Inventor: Kiyokazu Kaneko, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 268 days.

(21) Appl. No.: 14/007,311

(22) PCT Filed: Jan. 30, 2012

(86) PCT No.: PCT/JP2012/051955

§ 371 (c)(1),
(2), (4) Date: Dec. 2, 2013

(87) PCT Pub. No.: WO2012/127903

PCT Pub. Date: Sep. 27, 2012

(65) Prior Publication Data

US 2014/0159964 A1 Jun. 12, 2014

(30) Foreign Application Priority Data

Mar. 24, 2011 (JP) ..... 2011-066359

(51) Int. Cl.

| | |
|---|---|
| ***H01Q 1/32*** | (2006.01) |
| ***H01Q 1/42*** | (2006.01) |
| ***H01Q 1/24*** | (2006.01) |
| ***H01Q 1/27*** | (2006.01) |

(52) U.S. Cl.

CPC . *H01Q 1/24* (2013.01); *H01Q 1/27* (2013.01); *H01Q 1/32* (2013.01); *H01Q 1/3275* (2013.01); *H01Q 1/42* (2013.01)

(58) Field of Classification Search

USPC ..... 343/702, 713, 872

See application file for complete search history.

(56) References Cited

U.S. PATENT DOCUMENTS

| | | | |
|---|---|---|---|
| 3,659,678 | A | 5/1972 | Hall, Jr. |
| 4,490,003 | A | 12/1984 | Robinson |
| 4,563,659 | A | 1/1986 | Sakamoto |
| 4,781,623 | A | 11/1988 | Philippson et al. |
| 5,195,014 | A | 3/1993 | Krantz, Jr. et al. |
| 5,198,958 | A | 3/1993 | Krantz, Jr. et al. |
| 5,363,114 | A | 11/1994 | Shoemaker |
| 5,525,071 | A | 6/1996 | Obara et al. |
| 5,565,877 | A | 10/1996 | Du et al. |

(Continued)

FOREIGN PATENT DOCUMENTS

| | | |
|---|---|---|
| DE | 60105892 | 10/2005 |
| EP | 1162685 | 12/2001 |

(Continued)

*Primary Examiner* — Tan Ho

(74) *Attorney, Agent, or Firm* — Westerman, Hattori, Daniels & Adrian, LLP

(57) ABSTRACT

An outer peripheral wall and an inner peripheral wall are formed in the lower part of a shark-fin antenna case. The lower end surface of the inner peripheral wall is bonded to the upper surface of an insulating base in an antenna base arranged on the lower surface of the antenna case. Thus, an antenna assembly can be housed in the antenna case which is constructed to be waterproof. The antenna assembly is provided with an element holder that is arranged upright on the antenna base; an umbrella-shaped element that is fixed to the top part of the element holder in such a way that the rear part thereof is positioned above the insulating base; an amplifier substrate for amplifying a reception signal of the umbrella-shaped element; and a coil that causes the umbrella-shaped element to resonate at the specified frequency.

5 Claims, 24 Drawing Sheets

(56) References Cited

U.S. PATENT DOCUMENTS

| | | | | |
|---|---|---|---|---|
| 5,668,559 | A | 9/1997 | Baro | |
| 5,732,440 | A | 3/1998 | Wright | |
| 5,757,327 | A | 5/1998 | Yajima et al. | |
| 5,797,771 | A | 8/1998 | Garside | |
| 5,995,064 | A | 11/1999 | Yanagisawa et al. | |
| 6,175,080 | B1 | 1/2001 | Nightingale | |
| 6,177,911 | B1 | 1/2001 | Yuda et al. | |
| 6,310,586 | B1 | 10/2001 | Takahashi et al. | |
| 6,486,842 | B2 | 11/2002 | Wang | |
| 6,747,603 | B1 | 6/2004 | Tornatta et al. | |
| 6,879,301 | B2 | 4/2005 | Kozlovski | |
| 6,940,366 | B2 | 9/2005 | Komiya | |
| 7,019,701 | B2 | 3/2006 | Ohno et al. | |
| 7,037,144 | B2 | 5/2006 | Wang et al. | |
| 7,148,850 | B2 | 12/2006 | Puente Baliarda et al. | |
| 7,156,678 | B2 | 1/2007 | Feldman et al. | |
| 7,164,386 | B2 | 1/2007 | Baliarda et al. | |
| 7,170,459 | B1 | 1/2007 | McKim | |
| 7,202,822 | B2 | 4/2007 | Baliarda et al. | |
| 7,210,965 | B1 | 5/2007 | Zhong et al. | |
| 7,271,773 | B2 | 9/2007 | Gorai et al. | |
| 7,312,761 | B2 | 12/2007 | Gorai et al. | |
| 7,394,438 | B2 | 7/2008 | Forster et al. | |
| 7,414,588 | B2 | 8/2008 | Tateno | |
| 7,420,517 | B2 | 9/2008 | Oshima et al. | |
| 7,554,490 | B2 | 6/2009 | Baliarda et al. | |
| 7,598,913 | B2 | 10/2009 | Rao et al. | |
| 7,671,504 | B2 | 3/2010 | Rohrer et al. | |
| 7,845,983 | B2 | 12/2010 | Kawada et al. | |
| 7,868,834 | B2 | 1/2011 | Ortigosa et al. | |
| 7,961,065 | B2 | 6/2011 | Kobayashi et al. | |
| 8,207,893 | B2 | 6/2012 | Baliarda et al. | |
| 8,212,726 | B2 | 7/2012 | Baliarda et al. | |
| 8,471,772 | B2 | 6/2013 | Baliarda et al. | |
| 8,497,807 | B2 | 7/2013 | Wakui et al. | |
| 8,502,742 | B2 | 8/2013 | Wakui et al. | |
| 2001/0022716 | A1 | 9/2001 | Glaser et al. | |
| 2001/0050649 | A1 | 12/2001 | Wang | |
| 2002/0050873 | A1 | 5/2002 | Tsunoda et al. | |
| 2002/0080088 | A1 | 6/2002 | Boyle | |
| 2003/0058186 | A1 | 3/2003 | Saito et al. | |
| 2003/0112191 | A1 | 6/2003 | Maeda et al. | |
| 2004/0119644 | A1 | 6/2004 | Baliarda et al. | |
| 2005/0195112 | A1 | 9/2005 | Baliarda et al. | |
| 2005/0231427 | A1 | 10/2005 | Baliarda et al. | |
| 2005/0264453 | A1 | 12/2005 | Baliarda et al. | |
| 2006/0038726 | A1* | 2/2006 | Iacovella et al. | 343/713 |
| 2006/0040562 | A1 | 2/2006 | Funatsu | |
| 2006/0232488 | A1 | 10/2006 | Wang et al. | |
| 2006/0273968 | A1* | 12/2006 | Noro | 343/713 |
| 2006/0274472 | A1 | 12/2006 | Saito et al. | |
| 2006/0290587 | A1 | 12/2006 | Forster et al. | |
| 2007/0152886 | A1 | 7/2007 | Baliarda et al. | |
| 2007/0279302 | A1 | 12/2007 | Byrne et al. | |
| 2008/0117111 | A1 | 5/2008 | Ikeda et al. | |
| 2008/0129620 | A1* | 6/2008 | Zurowski et al. | 343/713 |
| 2008/0198082 | A1 | 8/2008 | Soler Castany et al. | |
| 2009/0109101 | A1 | 4/2009 | Baliarda et al. | |
| 2009/0115551 | A1 | 5/2009 | Kobayashi et al. | |
| 2009/0156059 | A1 | 6/2009 | Zhu et al. | |
| 2009/0207084 | A1* | 8/2009 | Ikeda et al. | 343/713 |
| 2009/0237313 | A1 | 9/2009 | Martinez Ortigosa | |
| 2009/0280688 | A1 | 11/2009 | Kawada et al. | |
| 2009/0303134 | A1 | 12/2009 | Baliarda et al. | |
| 2010/0007566 | A1 | 1/2010 | Kobayashi et al. | |
| 2010/0009565 | A1 | 1/2010 | Wang | |
| 2010/0245189 | A1 | 9/2010 | Wang | |
| 2010/0265147 | A1 | 10/2010 | Wakui et al. | |
| 2010/0277380 | A1 | 11/2010 | Breden et al. | |
| 2011/0074524 | A1 | 3/2011 | Nishioka | |
| 2011/0102269 | A1 | 5/2011 | Sato et al. | |
| 2011/0177839 | A1 | 7/2011 | Baliarda et al. | |
| 2011/0181478 | A1 | 7/2011 | Baliarda et al. | |
| 2011/0181481 | A1 | 7/2011 | Baliarda et al. | |
| 2011/0221640 | A1* | 9/2011 | Huber | 343/713 |
| 2011/0260934 | A1 | 10/2011 | Ilno et al. | |
| 2012/0326934 | A1 | 12/2012 | Wakui et al. | |
| 2013/0176180 | A1 | 7/2013 | Wakui et al. | |
| 2013/0342405 | A1* | 12/2013 | Ueno et al. | 343/713 |
| 2014/0292593 | A1* | 10/2014 | Thiam et al. | 343/713 |
| 2014/0340267 | A1* | 11/2014 | Kim | 343/713 |

FOREIGN PATENT DOCUMENTS

| | | | |
|---|---|---|---|
| JP | S55-138913 | | 10/1980 |
| JP | S59-078711 | | 5/1984 |
| JP | S60-126963 | | 8/1985 |
| JP | 2-32223 | | 2/1990 |
| JP | H04-257111 | | 9/1992 |
| JP | 5-39009 | U | 2/1993 |
| JP | H05-039009 | | 2/1993 |
| JP | H05-058223 | | 3/1993 |
| JP | H05-191124 | | 7/1993 |
| JP | H06-203897 | | 7/1994 |
| JP | 6-276013 | A | 9/1994 |
| JP | H06-276013 | | 9/1994 |
| JP | 7-36381 | | 4/1995 |
| JP | 7-176929 | | 7/1995 |
| JP | H07-272942 | | 10/1995 |
| JP | H09-213528 | | 8/1997 |
| JP | 9-232851 | A | 9/1997 |
| JP | H09-232851 | | 9/1997 |
| JP | 10-56315 | A | 2/1998 |
| JP | H10-056315 | | 2/1998 |
| JP | H11-040920 | | 2/1999 |
| JP | 2000-353573 | | 12/2000 |
| JP | 2001-291540 | | 10/2001 |
| JP | 2001-345613 | | 12/2001 |
| JP | 2002-359514 | | 12/2002 |
| JP | 2003-521146 | | 7/2003 |
| JP | 2003-521146 | A | 7/2003 |
| JP | 2003-264043 | | 9/2003 |
| JP | 2004-031068 | | 1/2004 |
| JP | 2004-082749 | | 3/2004 |
| JP | 2004-153502 | | 5/2004 |
| JP | 2004-159153 | | 6/2004 |
| JP | 2004-516700 | | 6/2004 |
| JP | 2005-102031 | | 4/2005 |
| JP | 2005-110200 | | 4/2005 |
| JP | 2006-033172 | | 2/2006 |
| JP | 2006-059646 | | 3/2006 |
| JP | 2006-108848 | | 4/2006 |
| JP | 2006-121369 | | 5/2006 |
| JP | 2006-178647 | | 6/2006 |
| JP | 2006-186881 | | 7/2006 |
| JP | 2006-166041 | | 8/2006 |
| JP | 2007-036354 | | 2/2007 |
| JP | 2007-072952 | | 3/2007 |
| JP | 2007-124892 | | 5/2007 |
| JP | 2008/035479 | | 2/2008 |
| JP | 2008-523671 | | 7/2008 |
| JP | 2008-523671 | A | 7/2008 |
| JP | 2009-290377 | | 12/2009 |
| JP | 2010-021856 | | 1/2010 |
| JP | 2010-21856 | A | 1/2010 |
| JP | 2011-035519 | | 5/2011 |
| WO | WO 2007/020902 | | 2/2007 |
| WO | PCT/JP2007/000505 | | 5/2007 |
| WO | WO 2008/001482 | | 1/2008 |
| WO | WO 2008/062746 | | 5/2008 |
| WO | PCT/JP2010/058364 | | 5/2010 |
| WO | 2010/137492 | A1 | 12/2010 |
| WO | PCT/JP2012/050527 | | 3/2012 |
| WO | 2012/096355 | A1 | 7/2012 |

* cited by examiner

A-A CROSS SECTION

A-A CROSS SECTION

B-B CROSS SECTION

C-C CROSS SECTION

D-D CROSS SECTION

E-E CROSS SECTION

ANTENNA DEVICE

CROSS REFERENCE TO RELATED APPLICATION

This is a 35 U.S.C. §371 application of, and claims priority to, International Application No. PCT/JP2012/051955, which was filed on Jan. 30, 2012, which claims priority to Japanese Patent Application No. 2011-066359, which was filed on Mar. 24, 2011, the entirety of all the applications are incorporated herein by reference.

TECHNICAL FIELD

The present invention relates to a small, low-profile antenna device that can be mounted on a car.

BACKGROUND ART

Conventionally, what has been known is an antenna device having only a limited space as in the case of an antenna device for vehicle that is equipped with an antenna case. FIGS. 41 to 43 show the configuration of the conventional antenna device 100. FIG. 41 is a side view showing the configuration of the conventional antenna device 100. FIG. 42 is a side view showing the internal configuration of the conventional antenna device 100. FIG. 43 is an exploded view of the conventional antenna device 100.

The conventional antenna device 100 shown in the above diagrams is an antenna device that is attached to a roof of the vehicle. When being attached to the vehicle, a portion protruding from the vehicle is about 66 mm in height, about 63 mm in width, and about 153 mm in length. The antenna device 100 takes a low-profile, and is able to receive AM broadcasting and FM broadcasting. The antenna device 100 has a streamline shape in such a way as to taper toward a tip. A flexible base pad that is made of rubber or elastomer is fitted on a lower surface of the antenna device 100, making it possible to attach the antenna device 100 to the vehicle in a watertight manner.

The conventional antenna device 100 includes an antenna case 110 which is made of resin; a metallic antenna base 120 on which a lower portion of the antenna case 110 is fitted; an antenna substrate 130 which is attached perpendicular to the antenna base 120; an amplifier substrate 134 which is attached parallel to the antenna base 120; a top section 131 which is formed into a mountain shape in cross section and is so disposed as to straddle the antenna substrate 130; and a GPS antenna 132 which is attached onto the antenna base 120. The antenna case 110 is made of synthetic resin that allows radio waves to pass therethrough, and includes an outer shell section 110*a* which has a streamline outer shape in such a way as to taper toward a tip in the antenna case 110, a space that houses the upright installed antenna substrate 130 and the top section 131 disposed on the antenna substrate 130, and a space that laterally houses the amplifier substrate 134 are formed. The metallic antenna base 120 is fitted on a lower surface of the antenna case 110. The antenna substrate 130 is installed upright and fixed on the antenna base 120. The amplifier substrate 134 is fixed substantially parallel, to the antenna base 120 in front of the antenna substrate 130. An antenna pattern is formed in an upper section of the antenna substrate 130. The top section 131 is built, in an upper section of the antenna case 110. The antenna case 110 is fitted on the antenna base 120, and the top section 131 that is built in the antenna case 110 is so disposed as to straddle an upper section of the antenna substrate 130. A joint fitting 136 that is attached to an upper section of the antenna substrate 130 electrically comes in contact with an inner surface of the top section 131. The joint fitting 136 is electrically connected to the antenna pattern formed on the antenna substrate 130. Therefore, via the joint fitting 136, the top section 131 and the antenna pattern are connected. As a result, the antenna pattern and the top section. 131 make up an antenna element; in a space inside the antenna case 110, the antenna substrate 130, the top section 131, and the amplifier substrate 134 are housed.

What is provided is a coil 135 that makes the antenna element which includes the antenna pattern and the top section 131 resonate around a FM wave band on the antenna substrate 130. One end of the coil 135 is connected to the antenna pattern. The other end of the coil 135 is connected to one end of a pattern formed on the antenna substrate 130. One end of a connection line 133 is connected to the other end of the pattern. The other end of the connection line 133 is connected to an input section of an AM/FM amplifier which is provided on the amplifier substrate 134. An AM/FM reception signal that is received by the antenna element including the antenna pattern and the top section 131 is input into the AM/FM amplifier and amplified. A bolt section 121 which is used to attach the antenna device 100 to the vehicle is so formed as to protrude from a lower surface of the antenna base 120. A cable 122 which feeds the reception signal from the antenna device 100 into the vehicle is extended out from a lower surface of the antenna base 120. The cable 122 is extended out from the amplifier substrate 134, and includes a cable that feeds an AM reception signal and FM reception signal that are amplified by the AM/FM amplifier provided on the amplifier substrate 134. Cables are bundled together by a collar 145. In this case, holes into which the bolt section 121 and the cable 122 are inserted are made in the roof of the vehicle. The antenna device 100 is placed on the roof in such a way that the bolt section 121 and the cable 122 are inserted into the holes. Then, a nut is fastened on the bolt section 121 that protrudes into the vehicle. As a result, the antenna device 100 is fixed to the roof of the vehicle. As for a power source for the amplifier substrate 134 that is housed in the antenna case 110, power is supplied to the amplifier substrate 134 from inside the vehicle via the cable 122.

The way the conventional antenna device 100 is assembled will be described with reference to an exploded, view shown in FIG. 43. In the conventional antenna device 100, the top section 131 is fixed with two screws 140 to an upper section inside the antenna case 110. A joint fitting 136 is fitted on an upper end of the antenna substrate 130. The joint fitting 136 holds the antenna substrate 130. Therefore, the joint fitting 136 is attached to an upper section of the antenna substrate 130. The coil 135 is soldered onto the antenna substrate 130. The antenna substrate 130 is installed upright and fixed on the antenna base 120 with two screws 141. The amplifier substrate 134 is placed ahead of the antenna substrate 130, and is fixed with three screws 142 so as to be substantially parallel to the antenna base 120. The cable 122 which outputs the amplified AM and FM reception signals is extended out from the amplifier substrate 134. A terminal 143 is mounted on a tip of the cable 122. The terminal 143 is fixed to a back surface of the amplifier substrate 134. One end of the wire like connection line 133 is connected to the antenna substrate 130. The other end of the connection line 133 is connected to the amplifier substrate 134. As a result, an output end of the coil 135 provided on the antenna substrate 130, and an input end of the AM/FM amplifier provided on the amplifier substrate 134 are connected; an AM/FM reception signal that is received by the antenna element including the antenna pattern and the top section 131 is input into the AM/FM amplifier on the amplifier substrate 134. The collar 145 is fitted to a base of the cable 122 in such a way as to bundle together the cable 122 that is pulled out from a pull-out hole of the antenna base 120.

A hook 144 is disposed, and is fitted on the antenna base 120 below the amplifier substrate 134. A pair of long engagement leg sections extend from both sides of the hook 144. When the antenna device 100 is attached to the vehicle, the engagement leg sections engage with an edge of a mounting hole that is formed on the vehicle, thereby working to temporarily fix the antenna device 100 to the vehicle body. Therefore, without holding the antenna device 100 from outside the vehicle body, it is possible to prevent the antenna device 100 from coming off the mounting hole when screwing the nut 147 on the bolt section 121 from inside the vehicle.

A base pad 124 is fitted on a lower surface of the antenna base 120. Five hole sections in total, into which heads of screws can be inserted are formed in a peripheral section of the base pad 124. Five screws 146 are inserted from below the hole sections. The screws 146 are inserted into fitting holes which are formed in a peripheral section of the antenna base 120, and are screwed into the periphery of the lower surface of the antenna case 110. In this manner, the antenna device 100 is assembled. The assembled antenna device 100 is attached in such a way that the bolt section 121 is aligned with the mounting hole that is formed on the vehicle. As a result, as described above, because of the hook 144, the antenna device 100 is temporarily fixed to the mounting hole. In this state, the nut 147 is screwed on the bolt section 121 from inside the vehicle. As a result, the antenna device 100 is attached to the vehicle body.

FIGS. 44 and 45 show the configuration of the antenna case 110 of the conventional antenna device 100. FIG. 44 is a side view showing the configuration of the antenna case 110 in cross section. FIG. 45 is a bottom view showing the configuration of the antenna case 110.

As shown in the diagrams, the antenna case 110 is made of synthetic resin that allows radio waves to pass therethrough, and has a streamline outer shape in such a way as to taper toward a tip. A space that houses the upright installed antenna substrate 130 and the top section 131 disposed on the antenna substrate 130, and a space that laterally houses the amplifier substrate 134 are formed in the antenna case 110. In order to put five screws, five screw holes 110*c* in total are formed on a lower surface: one in a front section, one in each of both sides of a central section, and one in each of both sides of a rear section. In order to form the screw holes 110*c*, five bosses 110*b* which bulge from around the screw holes 110*c*, are formed. Furthermore, two bosses 110*e* are formed in an upper section inside the antenna case 110 to fix the top section 131 with two screws 140.

As shown in FIGS. 42 and 43, the top section 131 of the conventional antenna device 100 is formed by processing a metal plate. The top section 131 includes an apex section with a curved surface that gradually goes down toward the front. A first side section and a second side section are so formed as to be inclined to both sides from the apex section. Three slits are formed on the first side section, and three slits on the second side section. Each of the side sections includes four pieces. Among the pieces, a pair of pieces that are almost near the center functions as contact pieces that are connected to the joint fitting 136. The middle portions of the contact pieces are bent and formed so as to be substantially vertical in such a way as not to come in contact with the bosses 110*b* which are so formed as to bulge toward the inside. Two flat sections are formed on the apex section of the top section 131. A screw hole is formed on each of the flat sections. Screws 140 are inserted into the screw holes, and screwed into the bosses 110*e* which are formed on an inner side of the apex section of the antenna case 110. Therefore, the top section 131 is attached inside the antenna case 110.

FIGS. 46 and 47 show the configuration of the antenna base 120 of the conventional antenna device 100. FIG. 46 is a plane view showing the configuration of the antenna base 120. FIG. 47 is a side view showing the configuration of the antenna base 120.

The antenna base 120 shown in the above diagrams is made of metal, and includes a main body section 120*a* that is substantially a rectangular plate that front section is tapered. Five fitting holes 120*f* are formed in total in a peripheral section of the main body section 120*a*. Screws 146 are inserted into the fitting holes 120*f* from below the fitting holes 120*f*, and are screwed into screw holes 110*c* which are formed on the lower surface of the antenna case 110. As a result, the antenna base 120 is fitted into the antenna case 110. Three bosses 120*e* are formed on the tapered front section of the main body section 120*a*. The amplifier substrate 134 is placed on the bosses 120*e*; screws 142 are inserted into the amplifier substrate 134, and are screwed into the bosses 120*e*. In this manner, the amplifier substrate 134 is fixed onto the antenna base 120.

Two screw sections 120*d* are formed in a horizontal direction in almost a central section and rear side of the main body section 120*a*. Screws 141 that are inserted into the mounting holes of the antenna substrate 130 are screwed into the screw sections 120*d*. As a result, the antenna substrate 130 is installed upright and attached to the antenna base 120. A rectangular-frame GPS antenna mounting section 120*b* which has a rectangular concave section is formed on a side that is slightly closer to a rear section of the main body section 120*a* than the center thereof. Screw holes 120*c* are formed at the four corners of the GPS antenna mounting section 120*b*. Four screws that are inserted into mounting holes of GPS antenna 132 are screwed into the screw holes 120*c*. In this manner, the GPS antenna 132 is mounted on the GPS antenna mounting section 120*b*. A rectangular cable pull-out hole 120*h* is formed in a central section of the main body section 120*a*. The cable 122 that is connected to the amplifier substrate 134 through the cable pull-out hole 120*h*, and a cable that is connected to the GPS antenna 132 can be pulled out.

Four first rectangular holes 120*g* and two second rectangular holes 120*i* are formed on a side that is slightly closer to a front section of the main body section 120*a* than the center thereof. Four fitting leg sections 144*b* of the hook 144 are inserted into the first rectangular holes 120*g*; the tips of the fitting leg sections 144*b* engage with a back surface of the antenna base 120. In this manner, the hook 144 is attached to the antenna base 120. Two engagement leg sections 144*c* of the hook 144 are inserted into the second rectangular holes 120*i*; the engagement leg sections 144*b* protrude from the lower surface of the antenna base 120 along the bolt section 121 as a result. The bolt section 121 is so formed as to protrude from a back surface of the main body section 120*a*. The collar 145 is provided to bundle together the cable 122 that is pulled out through the cable pull-out hole 120*h*.

FIGS. 48 and 49 show the configuration of the base pad 124 of the conventional antenna device 100. FIG. 48 is a plane view showing the configuration of the base pad 124. FIG. 49 is a side view showing the configuration of the base pad 124.

The base pad 124 shown in the above diagrams is made of rubber or elastomer. The base pad 124 includes a main body section 124*a* that is a flat plate having the shape of a half-cut, elongated oval which has a curved surface that is tapered toward a front section, and that rear end is linear. A peripheral wall section 124*b* is formed and shaped in such a way as to goes along an outer shape of the antenna base 120 on a surface of the main body section 124*a*. The antenna base 120 is placed on a surface of the base pad 124, and the antenna base 120 is fitted into the peripheral wall section 124*b*. As a result, the base pad 124 is fitted on the antenna base 120. Five hole sections 124*d* are formed in total along an inner side of the peripheral wall section 124*b*. The heads of the screws 146 that are inserted into the fitting holes 120*f* of the antenna base 120 from below the fitting holes 120*f* are inserted into the hole sections 124*d*. An oval cut-out hole 124*c* is formed from the center of the main body section 124*a* to a front section thereof. The bolt section 121, cable 122, and collar 145, which are provided on the lower surface of the antenna base 120, protrude through the cut-out hole 124*c*.

PRIOR ART DOCUMENT

Patent Document

Patent Document 1: Japanese Patent Application Kokai Publication No. 2010-21856

DISCLOSURE OF THE INVENTION

Problems to be Solved by the Invention

In the conventional antenna device 100, in order to protect functional components that receive radio waves from rain, dust, and the like, the reception functional components are housed in the antenna case 110, and the antenna base 120 is fixed to the antenna case 110 with the screws 146. In order to prevent rainwater and the like from entering the antenna case 110 through a gap between the antenna case 110 and the antenna base 120, a peripheral wall section 110*d* is provided in a lower section of the antenna case 110 to function as a waterproof rib. The base pad 124 is inserted between the peripheral wall section 110*d* and the antenna base 120, thereby creating a watertight structure and protecting the internal functional components. The antenna base 120 is a strength member that holds the functional components and the antenna case 110. The antenna base 120 also functions as a ground electrode of the amplifier substrate 134. The ground of the amplifier substrate 134 is electrically connected to the vehicle body via the bolt section 121 of the antenna base 120 and the nut 147.

The sensitivity of the conventional antenna device 100 is determined based on a distance between the top section 131 and an electrical ground plane that faces the top section 131. It is known that, as the distance becomes longer, and as the area of the top portion 131 becomes larger, the sensitivity becomes better and stable. In order to ensure reception performance, the top section 131 needs to be placed at a high position, or the top section 131 needs to be widened to expand the area. However, in order to fix the antenna base 120 to the antenna case 110 with the screws 146, a plurality of bosses 110*b* are formed on the inner side of the antenna case 110 to place the screw holes 110*c*. The bosses 110*b* are so formed as to bulge toward the inside. Therefore, the width of the top portion 131 is restricted to prevent the bosses 110*b* from interfering with the top section 131. Therefore, three slits are formed on each of the sides of the top section 131, thereby narrowing the width between the sides of the top section 131 that faces a boss 110*b*. Moreover, by law, an external projection of a car is required to be less than or equal to 70 mm. When the antenna device 100 is made smaller in size, in order to keep the distance between the top section 131 and the ground plane at a constant level or more, the top section 131 that is made lower is partially cut out. Therefore, the problem arises that the shape of the top section 131 is complex.

Furthermore, the base pad 124 is so shaped as to circumvent the bosses 110*b* of the antenna case 110 as shown in FIG. 48, and to hold the waterproof structure. The shape of the base pad 124 therefore is complex. There is a complex structure inside the antenna case 110 due to the bosses 110*b*, the peripheral wall section 110*d*, reinforcing ribs of the components, and the like. In order to improve the reception sensitivity, the internal space that houses the top section 131 needs to be large. Therefore, the antenna case 110 is so designed as to be thin. However, the above complex-shape portions cannot be made thinner. Therefore, the problem is that, when the antenna case 110 is molded, complex-structure portions of different thicknesses can shrink and deform easily and significantly, and that a shrinkage cavity is frequently created in such a way as to distort an exterior surface.

Furthermore, a maximum height of the antenna device 100 is a height limit for improving the reception sensitivity. Therefore, the sensitivity can be further improved in an effective manner by reducing the thickness of the antenna base 120 that faces the top section 131. However, the antenna base 120 is a strength member that also serves as a ground electrode. Moreover, in order to prevent water from entering the antenna case 110, the antenna base 120 needs to hold, with a great axial force, the base pad 124 between the antenna case 110 and the antenna base 120. Therefore, the problem is that the antenna base 120 cannot be made thinner, and becomes larger in size.

If the antenna base 120 becomes larger in size, the base pad 124, which covers a portion of the antenna base 120 that is exposed to the outside air in order to prevent corrosion caused by rainwater and the like, becomes larger in size, too. As a result, a vehicle's roof that is thin in thickness and low in rigidity is pressed by a large base pad 124. The roof is more easily deformed by the pressing force. The problem is that an external appearance is harmed, and the waterproof function is lowered.

Therefore, the object of the present invention is to provide an antenna device that can solve the above problems.

Means for Solving the Problems

To achieve the above object, the most important feature of an antenna device of the present invention is that the antenna device includes: an insulating antenna case that lower surface is open and in which a housing space is formed; an antenna base that includes an insulation base on which the antenna case is fitted, and a conductive base which is smaller than the insulation base and is fixed onto the insulation base; an insulating element holder that is installed upright and provided on the antenna base; an umbrella-type element that is fixed to an upper section of the element holder in such a way that a rear section thereof is located above the insulation base; an amplifier substrate that includes an amplifier which amplifies a signal received by the umbrella-type element, and is disposed on the conductive base and fixed to the antenna base; and a coil that is inserted between an output end of the umbrella-type element and an input end of the amplifier to make the umbrella-type element resonate at a predetermined frequency, wherein, when the antenna case is fitted onto the insulation base, a lower surface of the antenna case is welded or bonded to the insulation base to make a waterproof structure.

Advantages of the Invention

In the antenna device of the present invention, the lower surface of the antenna case is welded or bonded to the insulation base, thereby making a waterproof structure. Therefore, a large base pad is not required to make a waterproof structure. The antenna base does not have to hold the base pad with a great axial force. Therefore, the antenna base may not be a metallic strength member, and can be made from the insulation base. When the antenna device is attached to a vehicle, a roof is not distorted, and an external appearance is not harmed, and it is possible to prevent a waterproof function from being weakened. Furthermore, on the antenna case, there is no need to provide a boss on which a screw hole is formed to allow an antenna base to be fixed with a screw. As a result, the antenna case is thin and almost uniform in thickness. Therefore, the antenna case is unlikely to shrink and deform when being molded; it is possible to prevent a shrinkage cavity which distorts an exterior surface. Moreover, no boss is provided on the antenna case. Therefore, the configuration of the umbrella-type element can be simple.

Furthermore, the antenna base includes the insulation base and the conductive base. Therefore, a vehicle body works as a ground plane for the umbrella-type element on the insulation base. Thus, the height thereof is substantially increased, resulting in an improvement in reception sensitivity.

EMBODIMENTS FOR CARRYING OUT THE INVENTION

Figure 1:
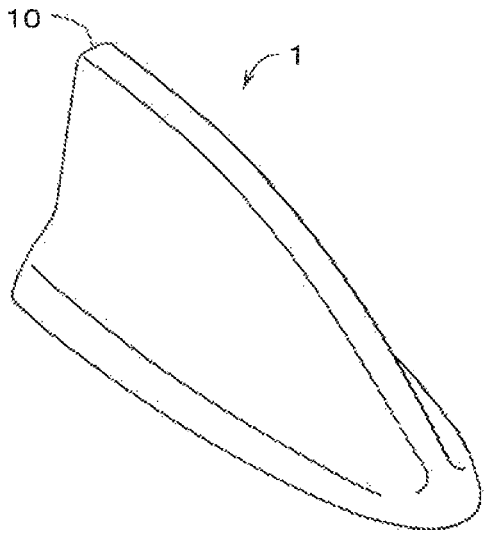
FIG. 1 is a perspective view showing the configuration of an antenna device according to an example of the present invention.
Figure 2:
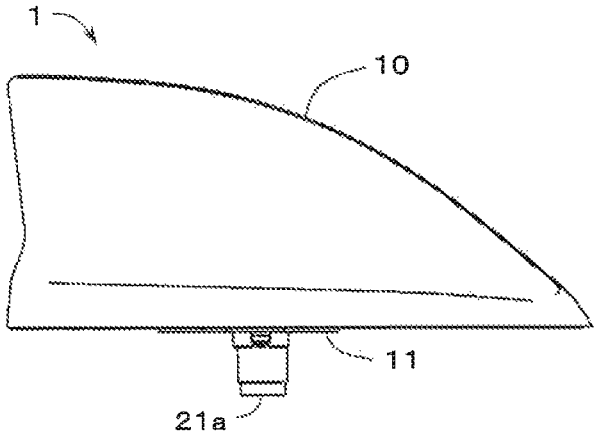
FIG. 2 is a side view showing the configuration of an antenna device according to an example of the present invention.
Figure 3:
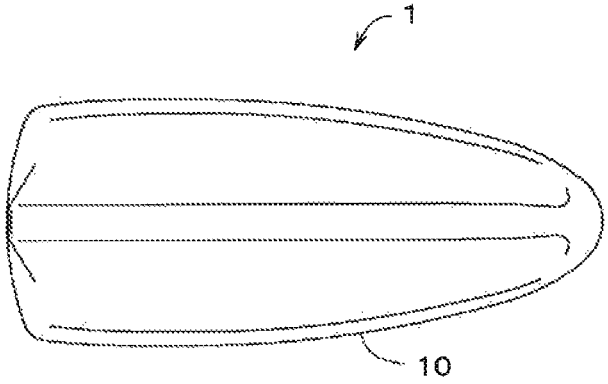
FIG. 3 is a top view showing the configuration of an antenna device according to an example of the present invention.
Figure 4:
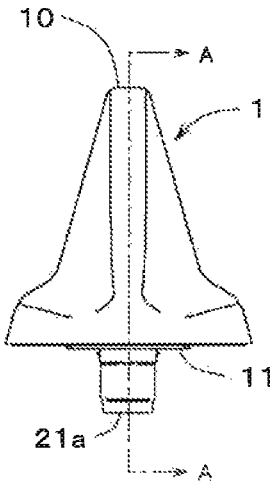
FIG. 4 is a front view showing the configuration of an antenna device according to an example of the present invention.

FIGS. 1 to 4 show the configuration of an antenna device 1 according to an example of the present invention. FIG. 1 is a perspective view showing the configuration of the antenna device 1 according to the present invention. FIG. 2 is a side view showing the configuration of the antenna device 1 according to the present invention. FIG. 3 is a top view showing the configuration of the antenna device 1*a* according to the present invention. FIG. 4 is a front view showing the configuration of the antenna device 1 according to the present invention.

As shown in the above diagrams, the antenna device 1 of the example of the present invention is an antenna device that is attached to a roof of a vehicle. The antenna device 1 includes an antenna case 10 with an antenna base 11 fitted onto a lower surface of the antenna case 10. The antenna case 10 is made of synthetic resin that allows radio waves to pass therethrough, and has a streamline outer shape (referred to as a "shark-fin shape") in such a way as to taper toward a tip with a curved surface having side faces bent toward an inner side. An antenna assembly which is described later is housed in the antenna case 10 having the lower surface onto which the antenna base 11 is fitted. A bolt section 21*a* which is used to attach the antenna device 1 to a vehicle body is so formed as to protrude from a lower surface of the antenna base 11. The antenna device 1 is a small, low-profile antenna device, and is about 151 mm in length, about 63 mm in width, and about 66 mm in height. The antenna device 1 can receive AM broadcasting and FM broadcasting.

Figure 5:
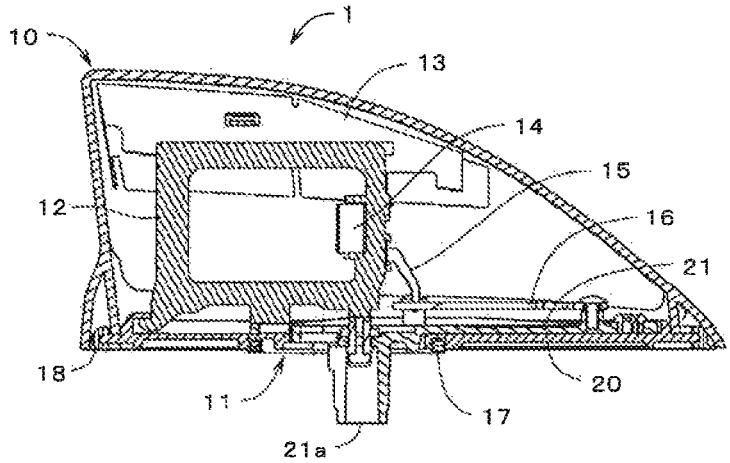
FIG. 5 is a side view showing the internal configuration of an antenna device in cross section according to an example of the present invention.
Figure 6:
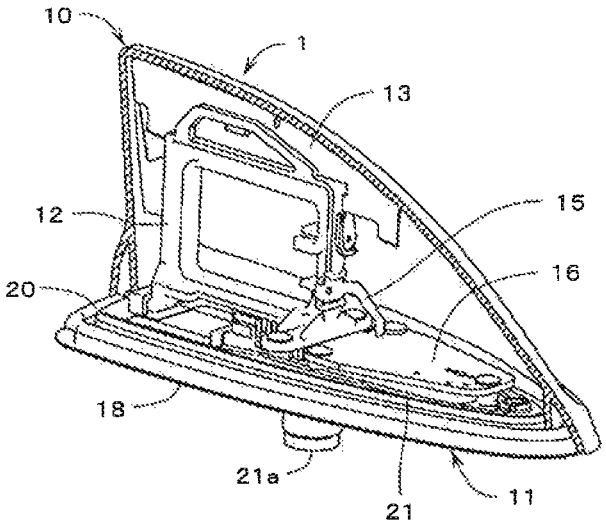
FIG. 6 is a perspective view showing the internal configuration of an antenna device in half-cross section according to an example of the present invention.

FIGS. 5 and 6 show the internal configuration of the antenna device 1 according to an example of the present invention. FIG. 5 is a side view showing, in A-A cross section, the internal configuration of the antenna device 1 according to the present invention. FIG. 6 is a perspective view showing, in half-cross section, the internal configuration of the antenna device 1 according to the present invention. Incidentally, FIG. 6 does not show a coil 14.

The antenna device 1 of the example of the present invention is an antenna device that can receive an AM radio band, and a FM radio band of 76 to 90 MHz or 88 to 108 MHz. The antenna device 1 includes the antenna case 10 that is made of resin; and the antenna base 11 that includes an insulation base 20 which is fitted onto the lower surface of the antenna case 10 and is made of resin, and a metallic conductive base 21. In the antenna base 11, the conductive base 21 is made smaller and shorter in length than the insulation base 20. The conductive base 21 is placed in an area extending from a front side to a central portion that is slightly closer to a rear side on the insulation base 20. A rear end of the conductive base 21 is fixed to the insulation base 20 in such a way as to be able to move slightly in a front-back direction. An element holder 12 which is a rectangular frame made of resin is installed upright and attached from a central portion of an upper surface of the antenna base 11 to the rear side. An amplifier substrate 16 is attached almost horizontally on the conductive base 21.

The bolt section 21*a* which is used to attach the antenna device 1 to a vehicle body is so formed as to protrude from the lower surface of the conductive base 21 of the antenna base 11. A plurality of cables which output reception signals and the like are pulled out from a through-hole of the bolt section 21*a* and a cable pull-out port that is formed at a rear side thereof. The element holder 12 includes a rectangular frame section; in an upper section of the frame section, a holding section is formed to support an umbrella-type element 13. A coil 14 of about 1 μH to 3 μH which is connected in series to the umbrella-type element 13 and makes the umbrella-type element 13 resonate with a FM frequency is held, inside a front-side portion of the upright installed frame of the element holder 12. A lead wire coming out of an upper end of the coil 14 is connected to a terminal of the umbrella-type element 13. A lead wire coming out of a lower end of the coil 14 is connected to a power supply terminal 15. The power supply terminal 15 is bent as shown in the diagram. An upper section of the power supply terminal 15 is fixed to a surface of the front-side portion of the upright installed frame of the element holder 12, with the surface facing the coil 14. A lower-end terminal thereof is connected to an input terminal of the amplifier substrate 16. Therefore, an AM/FM reception signal received by the umbrella-type element 13 that is connected in series to the coil 14 is amplified by an amplifier mounted on the amplifier substrate 16. Incidentally, an antenna that includes the umbrella-type element 13 and the coil 14 works as a non-resonant antenna in an AM radio band.

As shown in FIGS. 5 and 6, two peripheral wall sections, i.e. an outer peripheral wall section and an inner peripheral wall section are formed in a lower section of the antenna case 10. A lower-end surface of the inner peripheral wall section abuts against an outer-peripheral upper surface of the insulation base 20. The lower-end surface of the inner peripheral wall section that abuts, and the upper surface of the insulation base 20 that are welded together by laser, or bonded together after an adhesive agent is applied thereto. As the lower surface of the antenna case 10 is closed by the insulation base 20, the inside of the antenna case 10 turns into a waterproof structure. A gap cover 18, which is a string-like cover made of rubber or elastomer, is wound around on a peripheral side surface of the insulation base 20. A central cut-out section into which the bolt section 21*a* formed on the conductive base 21 is inserted is formed in a central section of the insulation base 20. A ring-shaped seal 17 which turns the inside of the central cut-out section into a waterproof structure is fitted into an annular section which is formed, on the lower surface of the insulation base 20 in such a way as to surround the central cut-out section.

Figure 7:
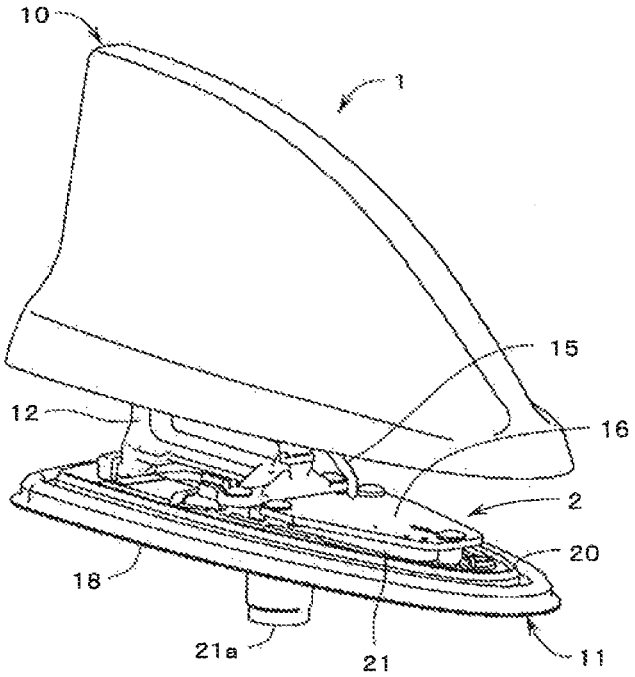
FIG. 7 is a diagram showing a situation where an antenna case is fitted onto an antenna assembly of an antenna device of the present invention.

FIG. 7 shows a situation where the antenna case 10 is fitted onto an antenna assembly 2 of the antenna device 1 of the present invention. After the situation shown in FIG. 7, the inner peripheral wall section of the antenna case 10 is fitted into the insulation base 20 of the antenna base 11. Then, the situation shown in FIGS. 5 and 6 appears. Incidentally, the antenna assembly 2 includes the element holder 12 which is mounted on the antenna base 11 having the insulation base 20 and the conductive base 21; the umbrella-type element 13; the coil 14; the power supply terminal 15; and the amplifier substrate 16.

Figure 8:
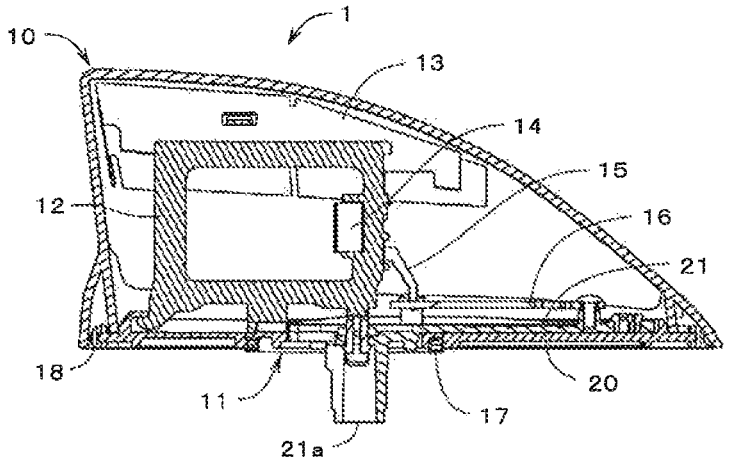
FIG. 8 is a perspective view showing the configuration of an antenna assembly of an antenna device of the present invention.
Figure 9:
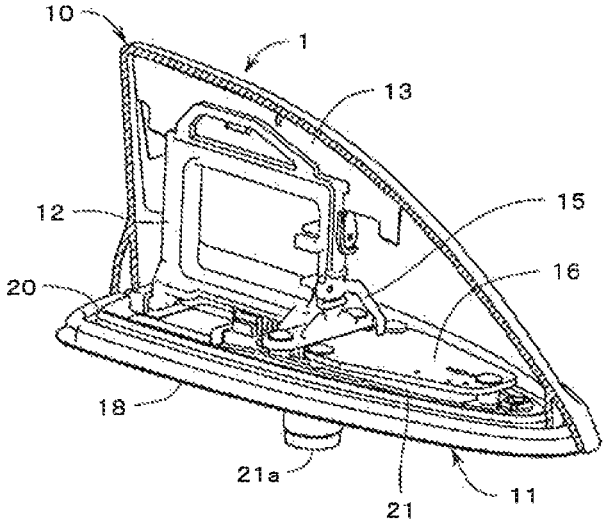
FIG. 9 is a top view showing the configuration of an antenna assembly of an antenna device of the present invention.
Figure 10:
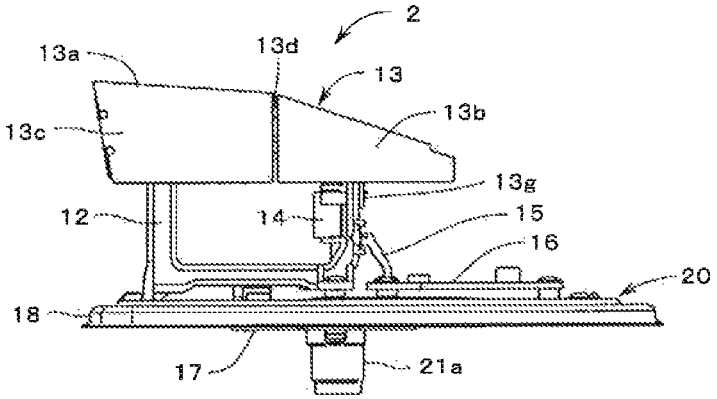
FIG. 10 is a side view showing the configuration of an antenna assembly of an antenna device of the present invention.
Figure 11:
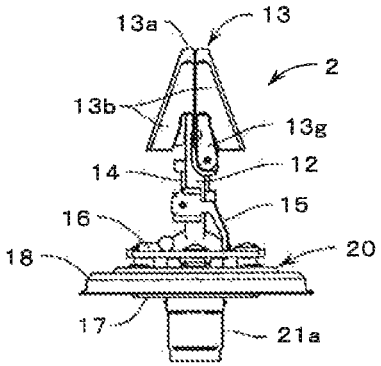
FIG. 11 is a front view showing the configuration of an antenna assembly of an antenna device of the present invention.

FIGS. 8 to 11 show the configuration of the antenna assembly 2 of the antenna device 1 of the present invention. FIG. 8 is a perspective view showing the configuration of the antenna assembly 2 of the antenna device 1 of the present invention. FIG. 9 is a top view showing the configuration of the antenna assembly 2 of the antenna device 1 of the present invention. FIG. 10 is a side view showing the configuration of the antenna assembly 2 of the antenna device 1 of the present invention. FIG. 11 is a front view showing the configuration of the antenna assembly 2 of the antenna device 1 of the present invention.

Figure 16:
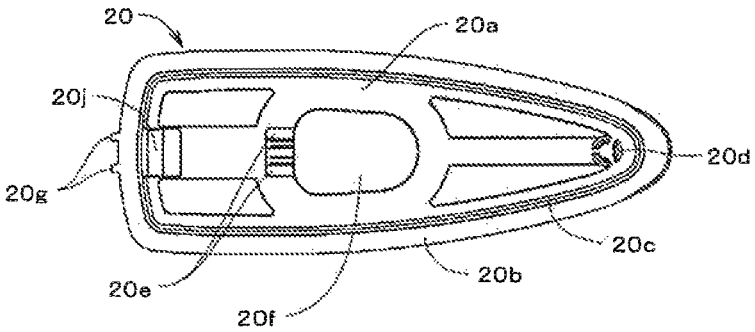
FIG. 16 is a top view showing the configuration of an insulation base of an antenna device of the present invention.
Figure 17:
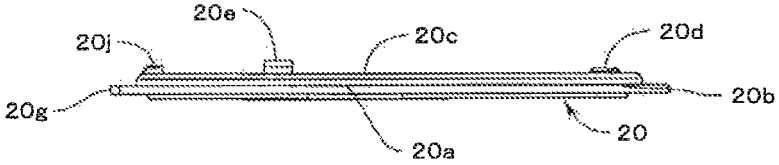
FIG. 17 is a side view showing the configuration of an insulation base of an antenna device of the present invention.
Figure 18:
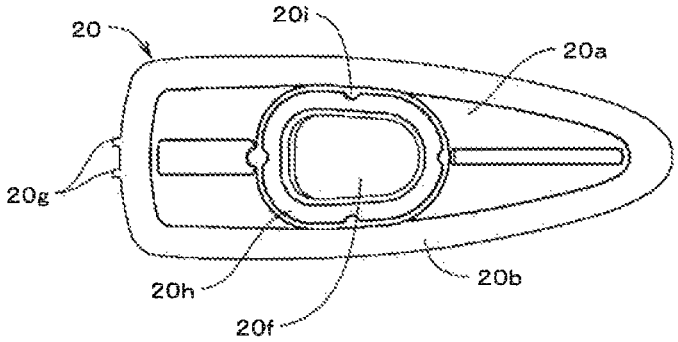
FIG. 18 is a bottom view showing the configuration of an insulation base of an antenna device of the present invention.

The antenna assembly 2 includes the antenna base 11 that has the insulation base 20 and the conductive base 21. The element holder 12, the umbrella-type element 13, the coil 14, the power supply terminal 15, and the amplifier substrate 16 are mounted on the antenna base 11. The configuration of the antenna base 11 that has the insulation base 20 and the conductive base 21 will be described. First, the configuration of the insulation base 20 will be described. FIG. 16 is a top view showing the configuration of the insulation base 20. FIG. 17 is a side view showing the configuration of the insulation base 20. FIG. 18 is a bottom view showing the configuration of the insulation base 20.

The insulation base 20 shown in the above diagrams is a molded article made of synthetic resin. The insulation base 20 includes a main body section 20*a* which gradually becomes narrower in width towards a front side and which has a rounded shape at a front end and a rear end. A peripheral wall section 20*c* of a predetermined height is so formed as to protrude from the upper surface and go along the outer peripheral edge in an area that is slightly closer to an inner side than an outer peripheral edge of the main body section 20*a*. At almost the center of a front side thereof, an engagement boss section 20*d* is formed on an upper surface of the main body section 20*a*. The engagement boss section 20*d* is in a substantially cylindrical shape, and three slits are formed vertically; at an outer side of a tip, an engagement section is so formed as to protrude in the shape of a wedge, and is elastic in a radial direction. A central cut-out section 20*f* which is substantially elliptical is formed in a central section of the main body section 20*a*. A pair of plate-like engagement pieces 20*e* is formed on a rear side of the central cut-out section 20*f*. Engagement sections are formed in the shape of a wedge on outer surfaces of tips of the engagement pieces 20*e* that are paired. A housing section 20*j* is so formed as to have a U-shape in cross section at an inner side of a rear section of the peripheral wall section 20*c* of the main body section 20*a*. A pair of small engagement projections 20*g* is so formed as to extend outward at a rear end of the main body section 20*a*. An annular groove 20*h* is so formed as to surround the central cut-out section 20*f* on a lower surface of the main body section 20*a*. The annular groove 20*h* is a groove into which the ring-shaped seal 17 is inserted. In order to prevent the inserted ring-shaped seal 17 from coming off, a plurality of pressing pieces 20*i* are so formed as to protrude from an upper end of the annular groove 20*h* to an inner side.

Figure 19:
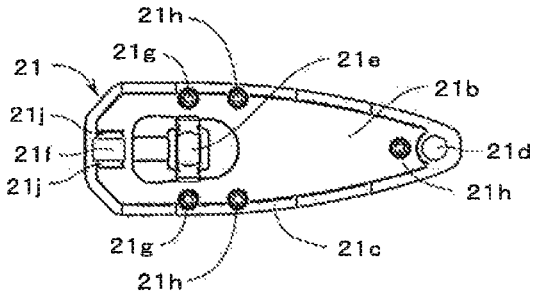
FIG. 19 is a top view showing the configuration of a conductive base of an antenna device of the present invention.
Figure 20:
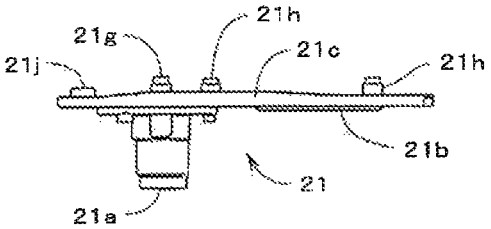
FIG. 20 is a side view showing the configuration of a conductive base of an antenna device of the present invention.
Figure 21:
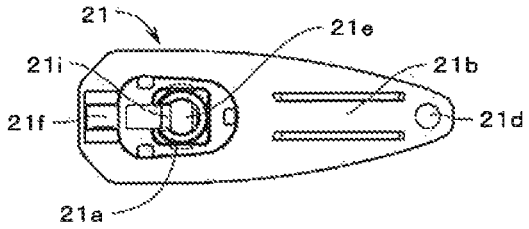
FIG. 21 is a bottom view showing the configuration of a conductive base of an antenna device of the present invention.

FIG. 19 is a top view showing the configuration of the conductive base 21. FIG. 20 is a side view showing the configuration of the conductive base 21. FIG. 21 is a bottom view showing the configuration of the conductive base 21.

The conductive base 21 shown in the above diagrams is made of metal. In order to allow the conductive base 21 to be housed inside the peripheral wall section 20*c* of the insulation base 20, the shape of the conductive base 21 is slightly smaller than an inner peripheral shape of the peripheral wall section 20*c*, and resembles the inner peripheral shape. However, the conductive base 21 is short so that a rear end thereof is positioned behind the engagement pieces 20*e* formed on the insulation base 20. At a front end thereof, a circular engagement hole 21*d* is formed on an upper surface of the conductive base 21. Three second bosses 21*h* on which screw holes are formed are formed on a rear side thereof, and on both sides of a substantially central section. The second bosses 21*h* are formed at the apexes of an isosceles triangle, and are bosses into which screws that are inserted into the amplifier substrate 16 are screwed.

Figure 36:
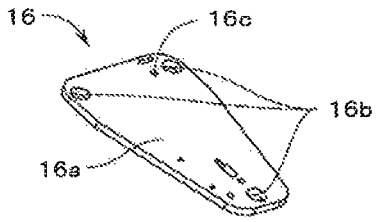
FIG. 36 is a perspective view showing the configuration of an antenna substrate of an antenna device of the present invention.

FIG. 36 is a perspective view showing the configuration of the amplifier substrate 16. As shown in the diagram, the amplifier substrate 16 includes a substrate main body 16*a* which becomes gradually narrower in width toward a front section from a rear section. Insertion holes 16*b* are formed in a substantially central portion of a front section thereof, and at both sides of a rear section thereof. The insertion holes 16*b* are formed at the apexes of an isosceles triangle. Screws are inserted into the insertion holes 16*b*, and are screwed into the three second bosses 21*h*. As a result, the amplifier substrate 16 is fixed to the conductive base 21. A connection hole 16*c* is formed in a rear section of the substrate main body 16*a*. The connection hole 16*c* is electrically connected to an input terminal of an amplifier mounted on the amplifier substrate 16.

Returning to FIGS. 19 to 21, a pair of first bosses 21*g* is formed on both sides of an area that is slightly closer to a rear side than a central section of the upper surface of the conductive base 21. A rectangular engagement hole 21*f* is formed in a substantially central section of a rear end of the upper surface. A pair of plate-like upright installation pieces 21*j* is so formed as to extend substantially parallel to a long axis on both sides of the engagement hole 21*f*. The bolt section 21*a* is so formed as to protrude in a section that is closer to the rear side than a central section of the lower surface of the main body section 21*b*. An insertion hole 21*e* is formed in the bolt section 21*a*. A notch 21*i* is formed on a side face of the bolt section 21*a*. A cable coming from the amplifier substrate 16 is inserted into the insertion hole 21*e* of the bolt section 21*a* from above the insertion hole 21*e*. The cable can be pulled out through the notch 21*i* in a lower section of the insertion hole 21*e*.

Figure 22:
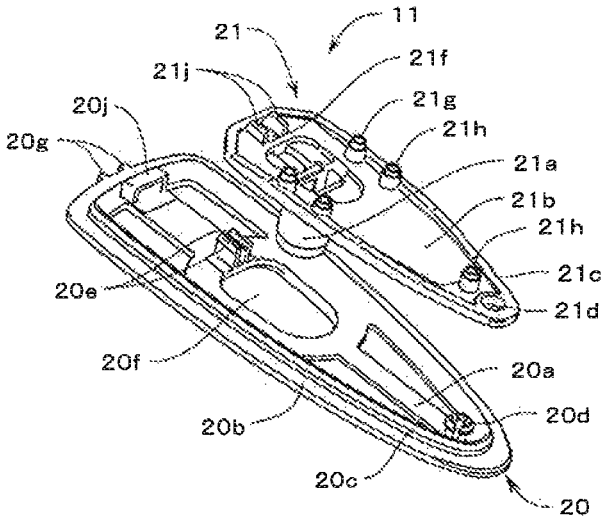
FIG. 22 is a perspective view showing the configuration of assembling of an antenna base of an antenna device of the present invention.
Figure 23:
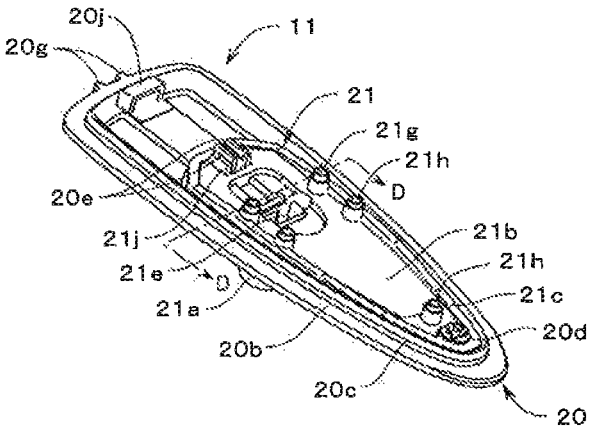
FIG. 23 is a perspective view showing the configuration of an antenna base of an antenna device of the present invention.
Figure 24:
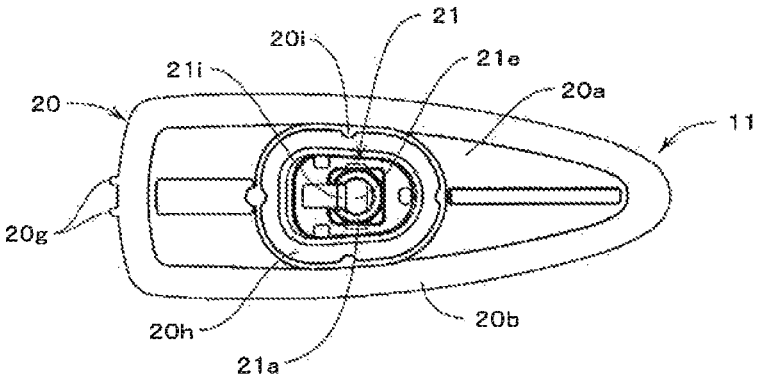
FIG. 24 is a bottom view showing the configuration of an antenna base of an antenna device of the present invention.
Figure 25:
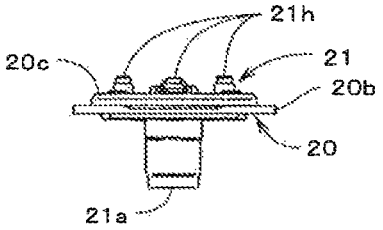
FIG. 25 is a front view showing the configuration of an antenna base of an antenna device of the present invention.
Figure 26:
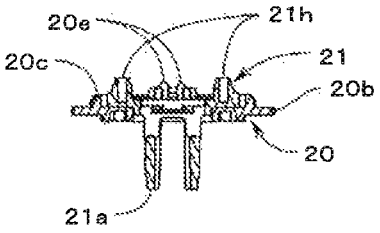
FIG. 26 is a front view showing, in cross section, the configuration of an antenna base of an antenna device of the present invention.

FIGS. 22 to 26 show the configuration of the antenna base 11 having the insulation base 20 and the conductive bate 21. FIG. 22 is a perspective view showing the configuration of assembling of the antenna base 11. FIG. 23 is a perspective view showing the configuration of the assembled antenna base 11. FIG. 24 is a bottom view showing the configuration of the assembled antenna base 11. FIG. 25 is a front view showing the configuration of the assembled antenna base 11. FIG. 26 is a front view showing, in D-D cross section, the configuration of the assembled antenna base 11.

As shown in FIG. 22, the conductive base 21 is disposed above the insulation base 20. Then, the conductive base 21 is placed on the insulation base 20. The engagement boss section 20*d* of the insulation base 20 is inserted into the engagement hole 21*d* of the conductive base 21. A pair of engagement pieces 20*e* of the insulation base 20 is inserted into the engagement hole 21*f* of the conductive base 21. As a result, a tip engagement section of the engagement boss section 20*d* is locked in an area near an upper end of the engagement hole 21*d*. Moreover, the engagement sections that are formed at the tips of the engagement pieces 20*e* engage with upper surfaces of the upright installation pieces 21*j* of the conductive base 21. As a result, the conductive base 21 is fixed to the insulation base 20 in such a way that the conductive base 21 does not come off the insulation base 20. A first engagement section in which the engagement boss section 20*d* engages with the engagement hole 21*d* is an engagement section for positioning. A second engagement section in which the engagement pieces 20*e* engage with the upright installation pieces 21*j* is an engagement section that can slide in a longitudinal axial direction. Therefore, even when the conductive base 21 and the insulation base 20 are changed in length relative to each other due to a difference in the coefficient of thermal expansion between the conductive base 21 and the insulation base 20, the difference in length can be canceled by the second engagement section. FIGS. 23 to 26 show the configuration of the antenna base 11, with the conductive base 21 fixed onto the insulation base 20.

Figure 12:
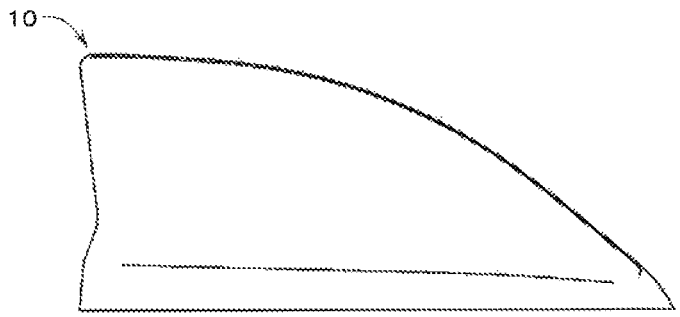
FIG. 12 is a side view showing the configuration of an antenna case of an antenna device of the present invention.
Figure 13:
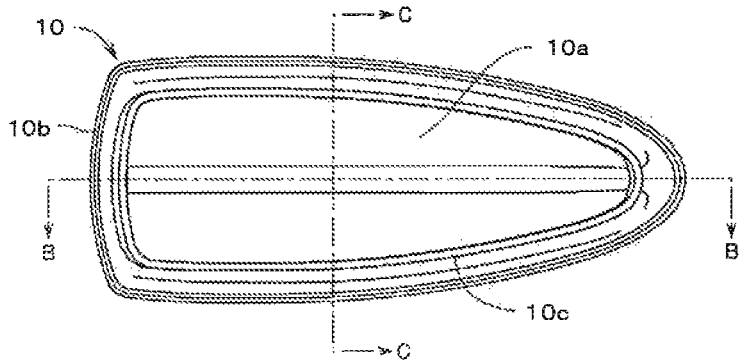
FIG. 13 is a bottom view showing the configuration of an antenna case of an antenna device of the present invention.
Figure 14:
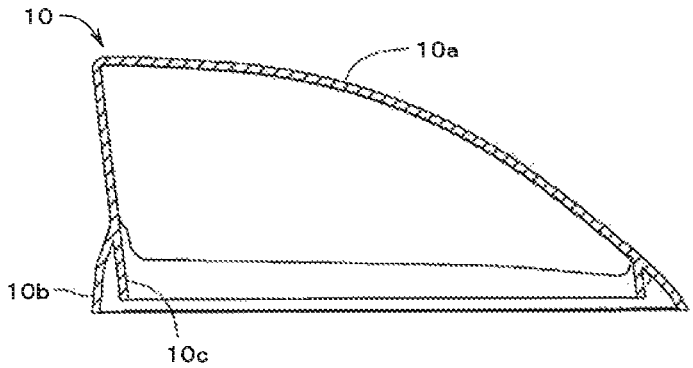
FIG. 14 is a side view showing, in cross section, the configuration of an antenna case of an antenna device of the present invention.
Figure 15:
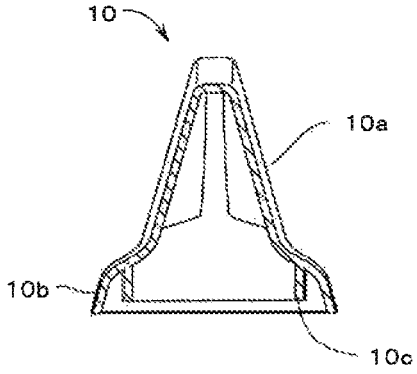
FIG. 15 is a front view showing, in cross section, the configuration of an antenna case of an antenna device of the present invention.

FIGS. 12 to 15 show the configuration of the antenna case 10 of the antenna device 1 of the present invention. FIG. 12 is a side view showing the configuration of the antenna case 10 of the antenna device 1 of the present invention. FIG. 13 is a bottom view showing the configuration of the antenna case 10 of the antenna device 1 of the present invention. FIG. 14 is a side view showing, in B-B cross section, the configuration of the antenna case 10 of the antenna device 1 of the present invention. FIG. 15 is a front view showing, in C-C cross section, the configuration of the antenna case 10 of the antenna device 1 of the present invention.

As shown in the above diagrams, the antenna case 10 is made of synthetic resin that allows radio waves to pass therethrough, and has a shark-fin shape in such a way as to taper toward a tip with a curved surface having side faces bent toward an inner side. The antenna case 10 includes an outer shell section 10*a* that is thin in thickness. Two thin peripheral wall sections are formed in a lower section of the antenna case 10. An outer peripheral wall section 10*b* is formed on an outer side. An inner peripheral wall section 10*c* is formed on an inner side. When the antenna case 10 is fitted onto the antenna assembly 2, the inner peripheral wall section 10*c* is fitted onto an outer periphery of the peripheral wall section 20*c* that is formed on the upper surface of the insulation base 20 which is made of synthetic resin in the antenna base 11; a lower-end surface of the inner peripheral wall section 10*c* abuts against the upper surface of the insulation base 20. The portions that abut each other are welded together by irradiation of laser, or bonded together after an adhesive agent is applied thereto. As a result, the antenna assembly 2 is housed inside a waterproof structure that is formed by the antenna case 10 and the insulation base 20.

As described, above, the lower-end surface of the antenna case 10 is fixed onto the insulation base 20 by means of welding or bonding. Therefore, in the antenna case 10, there is no need to provide a boss in which a screw hole is formed to allow the antenna base 11 to be fixed with a screw. Accordingly, the antenna case 10 can have the thin outer shell section 10*a* that is uniform in thickness. Therefore, the antenna case 10 is unlikely to shrink and deform when being molded; it is possible to prevent a shrinkage cavity, which distorts an exterior surface, from occurring.

Figure 27:
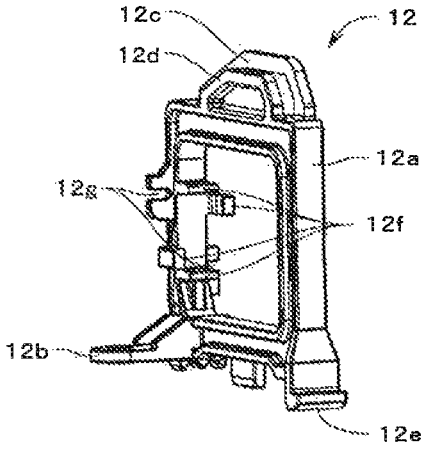
FIG. 27 is a perspective view showing the configuration of an element holder of an antenna device of the present invention.
Figure 28:
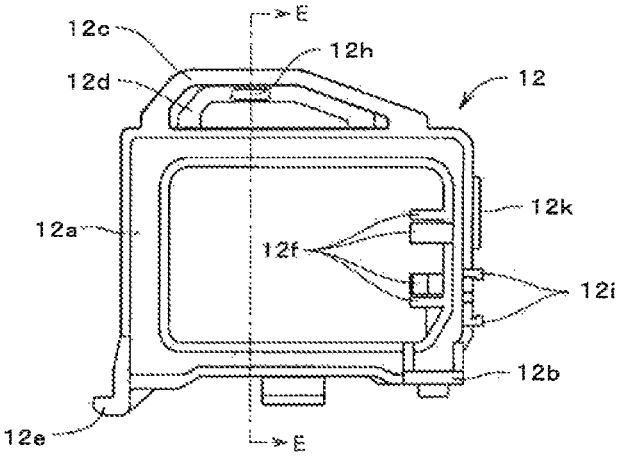
FIG. 28 is a side view showing the configuration of an element holder of an antenna device of the present invention.
Figure 29:
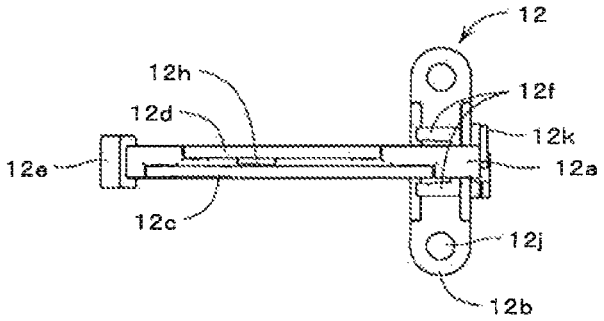
FIG. 29 is a top view showing the configuration of an element holder of an antenna device of the present invention.
Figure 30:
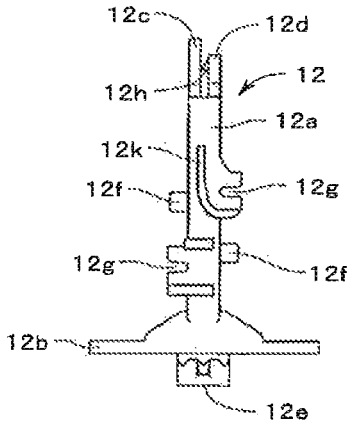
FIG. 30 is a front view showing the configuration of an element holder of an antenna device of the present invention.
Figure 31:
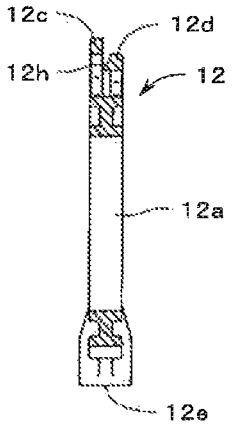
FIG. 31 is a side view showing, in cross section, the configuration of an element holder of an antenna device of the present invention.

FIGS. 27 to 31 show the configuration of the element holder 12 of the antenna device 1 of the present invention. FIG. 27 is a perspective view showing the configuration of the element holder 12 of the antenna device 1 of the present invention. FIG. 28 is a side view showing the configuration of the element holder 12 of the antenna device 1 of the present invention. FIG. 29 is a top view showing the configuration of the element holder 12 of the antenna device 1 of the present invention. FIG. 30 is a front view showing the configuration of the element holder 12 of the antenna device 1 of the present invention. FIG. 31 is a front view showing, in E-E cross section, the configuration of the element holder 12 of the antenna device 1 of the present invention.

The element holder 12 shown in the above diagrams includes a rectangular frame section 12*a*. A first holding section 12*c* and a second holding section 12*d* are so formed as to face each other in an upper section of the frame section 12*a*, in order to support the umbrella-type element 13. The frame section 12*a* is rectangular in cross section. A leg section 12*b* is so formed as to extend laterally at a lower end of a front side of the element holder 12. Insertion holes 12*j* are formed at both ends of the leg section 12*b*. Screws are inserted into the insertion holes 12*j*, and are screwed into the first bosses 21*g* that are paired and formed on the conductive base 21. An L-shaped engagement claw 12*e* is so formed as to protrude at a lower end of a rear side of the element holder 12. The engagement claw 12*e* is housed in the housing section 20*j*, which is formed in a U-shape in cross section and is formed on the insulation base 20. The engagement claw 12*e* engages with the housing section 20*j* in such a way that the engagement claw 12*e* does not come off.

The first holding section 12*c* and the second holding section 12*d* are formed into a substantially U-shape. The first holding section 12*c* is made higher than the second holding section 12*d*. In a substantially central area of a surface of the second holding section 12*d* that faces the first holding section 12*c*, a wedge-shaped engagement projection 12*h* is formed. Into a gap between the first holding section 12*c* and the second holding section 12*d*, a folded section that is formed on an inner side of the umbrella-type element 13 in a long-axis direction is inserted. When the folded section is inserted, the engagement projection 12*h* engage with an engagement window that is formed on the folded section. As a result, the umbrella-type element 13 is supported by the element holder 12 in such a way as to prevent the umbrella-type element 13 from coming off the first holding section 12*c* and the second holding section 12*d*. Moreover, a terminal that is provided at a lower end of the umbrella-type element 13 is retained by a rounded, L-shaped terminal retaining section 12*k*. The terminal retaining section 12*k* is formed on an outer-side surface of a front side of the frame section 12*a* of the element holder 12. Four coil retaining pieces 12*f* which are used to retain the coil 14 are formed vertically and horizontally on an inner side of a front side of the frame section 12*a* of the element holder 12. Terminal retaining pieces 12*i* which retain the power supply terminal 15 are formed on an outer-side surface of a front side of the frame section 12*a* of the element holder 12.

Figure 32:
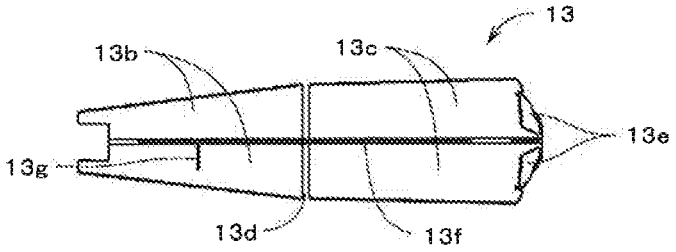
FIG. 32 is a top view showing the configuration of an umbrella-type element of an antenna device of the present invention.
Figure 33:
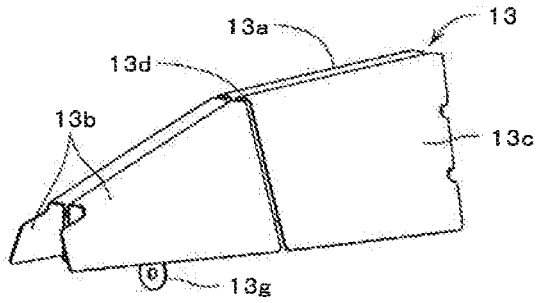
FIG. 33 is a perspective view showing a situation where an umbrella-type element of an antenna device of the present invention is mounted on an element holder.
Figure 33:
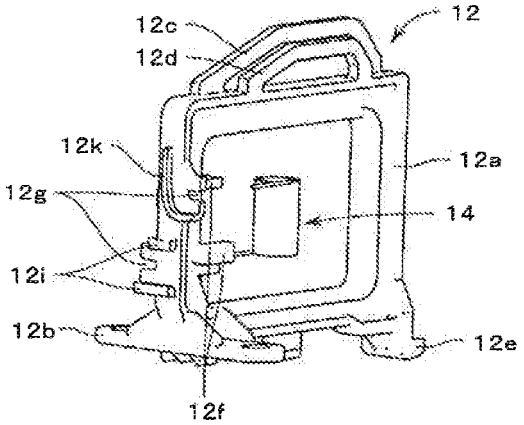
Figure 34:
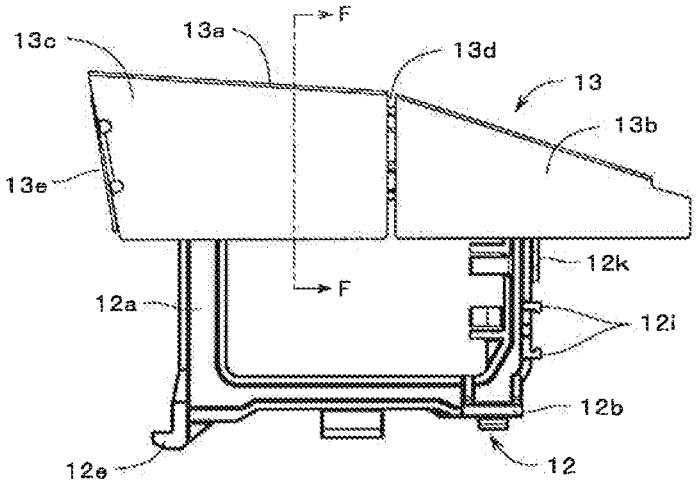
FIG. 34 is a side view showing the structure in which an umbrella-type element of an antenna device of the present invention is mounted on an element holder.
Figure 35:
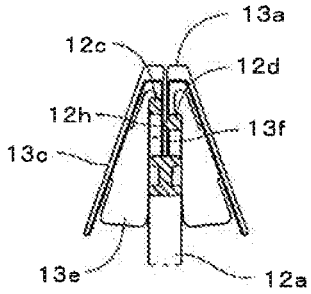
FIG. 35 is a front view showing, in cross section, a portion of the structure in which an umbrella-type element of an antenna device of the present invention is mounted on an element holder.

FIG. 32 is a bottom view showing the configuration of the umbrella-type element 13. FIG. 33 is a perspective view showing a situation where the umbrella-type element 13 and the coil 14 are mounted on the element holder 12. FIG. 34 is a side view showing a situation where the umbrella-type element 13 is mounted on the element holder 12. FIG. 35 is a front view showing, in F-F cross section, a situation where the umbrella-type element 13 is mounted on the element holder 12.

As shown in the above diagrams, the umbrella-type element 13 includes an apex section 13*a* that is made flat; a roof-shaped inclined section is so formed as to incline from both sides of the apex section 13*a*. Only one slit 13*d* is formed In a substantially central area of the inclined section. An area ahead of the slit 13*d* is referred to as a first inclined section 13*b*, and an area behind the slit 13*d* is referred to as a second inclined section 13*c*. A pair of back surface sections 13*e* which are made by bending a side edge of a rear end of the second inclined section 13*c* is formed. An inclination angle of an area of the apex section 13*a* where the first inclined section 13*b* is formed is greater than an inclination angle of an area of the apex section 13*a* where the second inclined section 13*c* is formed. The umbrella-type element 13 is made by bending a thin metal plate of a predetermined shape that is cut out. A folded section 13*f* which extends downward from the center of the apex section 13*a* is formed. A terminal 13*g* is formed laterally from the folded section 13*f*. An engagement window with which the engagement projection 12*h* of the element holder 12 can engage is formed on an inner side of the folded section 13*f* of the second inclined section 13*c*.

Incidentally, in the antenna device 1 of the present invention, no boss is provided on the antenna case 10. Therefore, there is no need to prevent a boss from interfering with the umbrella-type element 13, and the shape of the umbrella-type element 13 can be simple.

Figure 37:
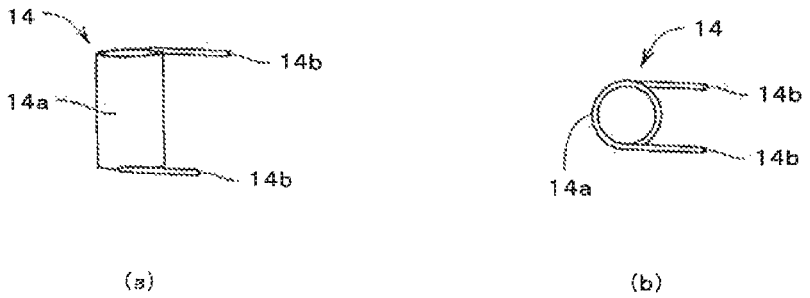
FIG. 37 is a perspective view and top view showing the configuration of a coil of an antenna device of the present invention.

FIG. 37A is a perspective view showing the configuration of the coil 14. FIG. 37B is a top view showing the configuration of the coil. As shown in the above diagrams, the coil 14 includes a coil main body 14*a* which is wound in a cylindrical shape; a lead 14*b* which is led out in a tangential direction from an upper end of the coil main body 14*a*; and a lead 14*b* which is led out in a tangential direction from a lower end of the coil main body 14*a*. In this manner, the distance between the two leads 14*b* is substantially equal to the diameter of the coil main body 14*a*. The coil 14 is a coil of about 1 μH to 3 μH which is connected in series to the umbrella-type element 13 and makes the umbrella-type element 13 resonate with a FM frequency.

Figure 38:
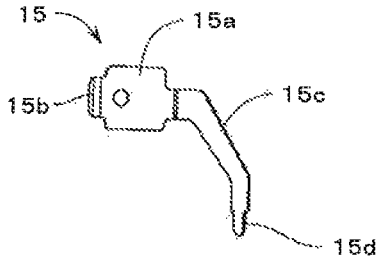
FIG. 38 is a perspective view showing the configuration of a power supply terminal of an antenna device of the present invention.

FIG. 38 is a perspective view showing the configuration of the power supply terminal 15. As shown in the diagram, a rectangular planar section 15*a* is formed at an end section of the power supply terminal 15*a* bent section 15*b* is formed at one edge thereof. The planar section 15*a* is retained by the terminal retaining pieces 12*i* of the element holder 12 after being positioned with the help of the bent section 15*b*. As the planar section 15*a* is retained, a hole that is formed in the planar section 15*a* is aligned with a lead-out groove 12*g*. A lead-out section 15*c* that is bent is stretched and formed from the other edge of the planar section 15*a*. A terminal strip 15*d* is formed at a tip of the lead-out section 15*c*. The terminal strip 15*d* is inserted into the connection hole 16*c* of the amplifier substrate 16 where the terminal strip 15*d* is soldered. As a result, the terminal strip 15*d* is connected to an input terminal of an amplifier.

As shown in FIG. 33, after being disposed above the element holder 12, the umbrella-type element 13 is moved downward, and the folded section 13*f* thereof is inserted into the gap between the first holding section 12*c* and the second holding section 12*d*. As the folded section 13*f* is pushed into the gap, as shown in FIG. 35, the wedge-shaped engagement projection 12*h* that is formed on the inner side of the second holding section 12*d* engages with the engagement window that is formed in the folded section 13*f*. As a result, the umbrella-type element 13 is attached firmly to the element holder 12. At this time, the terminal 13*g* that is formed on the folded section 13*f* is retained in the terminal retaining section 12*k* of the element holder 12. Then, the coil 14 shown in FIG. 33 is inserted into a holding space surrounded by the four coil retaining pieces 12*f*. As a result, the coil 14 is retained by the four coil retaining pieces 12*f*. The lead 14*b* coming out of the upper end of the coil 14 is led out through a lead-out groove 12*g* that is formed in the terminal retaining section 12*k*. Then, the lead 14*b* inserted into a hole of the terminal 13*g* of the umbrella-type element 13 retained by the terminal retaining section 12*k*, and is soldered to the terminal 13*g*. The lead 14*b* coming out of the lower end of the coil 14 is led out through a lead-out groove 12*g* that is formed between the terminal retaining pieces 12*i*. Then, the lead 14*b* is inserted into a hole of the power supply terminal 15 retained by the terminal retaining pieces 12*i*, and is soldered to the power supply terminal 15. In this manner, the coil 14 is disposed substantially at the center in a width direction of the element holder 12. That is, because the coil 14 is disposed substantially at the center in a width direction of the umbrella-type element 13, the interference of the umbrella-type element 13 with the coil 14 can be avoided as much as possible. Therefore, while maintaining the same level of reception performance, it is possible to reduce the width of the umbrella-type element 13. Thus, it is possible to improve the design by reducing the width of the upper section of the antenna case 10.

Figure 39:
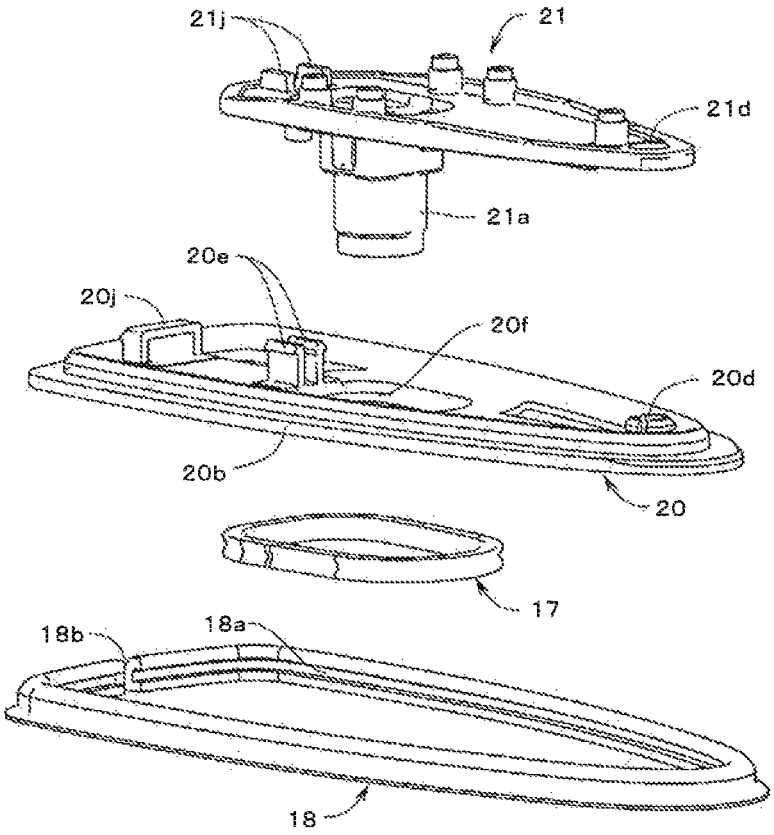
FIG. 39 is a perspective view showing assembling of an umbrella-type element of an antenna device of the present invention, an element holder, a ring-shaped pad, and a gap cover.

FIG. 39 is a perspective view showing assembling of the umbrella-type element 13 of the antenna device 1 of the present invention, the element holder 12, the ring-shaped seal 17, and the gap cover 18.

As shown in the diagram, the conductive base 21 is disposed above the insulation base 20. Then, the conductive base 21 is placed on the insulation base 20. The engagement boss section 20*d* of the insulation base 20 is inserted into the engagement hole 21*d* of the conductive base 21. A pair of engagement pieces 20*e* of the insulation base 20 is inserted into the engagement hole 21*f* of the conductive base 21. As a result, the tip engagement section of the inserted engagement boss section 20*d* is locked in an area near the upper end of the engagement hole 21*d*. Moreover, the engagement sections that are formed at the tips of the engagement pieces 20*e* engage with the upper surfaces of the upright installation pieces 21*j* of the conductive base 21. As a result, the conductive base 21 is fixed to the insulation base 20 in such a way that the conductive base 21 does not conic off the insulation base 20. At this time, the bolt section 21*a* that is so formed as to protrude from the lower surface of the conductive base 21 passes through the central cut-out section 20*f* of the insulation base 20, and protrudes from the lower surface of the insulation base 20.

Then, the ring-shaped seal 17 is inserted into the annular groove 20*h* shown in FIG. 24 that is formed around the central cut-out section 20*f* on the lower surface of the insulation base 20. The pressing pieces 20*i* that are formed on an outer peripheral edge of the annular groove 20*h* abut against a flat upper surface of the ring-shaped seal 17. Therefore, the ring-shaped seal 17 is retained in the annular groove 20*h*. The gap cover 18 is a string-like cover, with a cut section 18*b* at both ends thereof. A hole section is formed in an area of the cut section 18*b* that is slightly closer to an inner side. One of the engagement projections 20*g* that are formed at the rear end of the insulation base 20 is inserted into the hole section. As a flange section 20*b* that is formed on a peripheral side surface of the insulation base 20 is fitted into a groove section 18*a* of the gap cover 18, the gap cover 18 is wound around the peripheral side surface of the insulation base 20. The other engagement projection 20*g* is inserted into a hole section formed in an area that is slightly closer to an inner side than the winding end of the cut section 18*b*. In this manner, the gap cover 18 is mounted on the peripheral side surface of the insulation base 20.

In the case of the conventional antenna device, as a rigid body structure that includes the antenna case and the antenna base, the base pad is held with a great axial force to realize a waterproof structure. In the antenna device 1 of the present invention, the antenna case 10 and the insulation base 20 are welded or bonded together, thereby realizing a waterproof structure. Therefore, there is no need to use the conductive base 21 as a strength member. As long as the conductive base 21 can press the ring-shaped seal 17, the conductive base 21 can be made smaller in size. Incidentally, the conductive base 21 also functions as a ground of the amplifier substrate 16.

Returning to the description of the antenna assembly 2, each component of the antenna assembly 2 is configured as described above. In the antenna assembly 2 shown in FIGS. 8 to 11, the gap cover 18 is mounted on the outer periphery of the antenna base 11 including the insulation base 20 and the conductive base 21 that is mounted on the upper surface of the insulation base 20. The element holder 12 is installed upright and fixed on the antenna base 11. Moreover, the amplifier substrate 16 is fixed almost horizontally. The umbrella-type element 13 is attached to the upper section of the element holder 12. The coil 14 is held on the inner side of the frame section 12*a* of the element holder 12. The upper lead of the coil 14 is connected to the terminal 13*g* of the umbrella-type element 13. The lower lead of the coil 14 is connected to one end of the power supply terminal 15. The other end of the power supply terminal 15 is connected to an input terminal of an amplifier of the amplifier substrate 16. A signal received by an antenna that includes the umbrella-type element 13 and the coil 14 is amplified by the amplifier of the amplifier substrate 16.

In the antenna assembly 2, the first inclined section 13*b* of the umbrella-type element 13 is located above the conductive base 21. The height of the first inclined section 13*b* from the ground plane is equal to the height from the conductive base 21. The second inclined section 13*c* of the umbrella-type element 13 is located substantially above the insulation base 20. The height of the second inclined section 13*c* from the ground plane is substantially equal to the height from the vehicle body to which the antenna device 1 is attached. In this manner, even as the height of the antenna device 1 is decreased, the height of the second inclined section 13*c* from the ground plane is substantially increased. The increase helps improve the actual gain of the antenna device 1.

Figure 40:
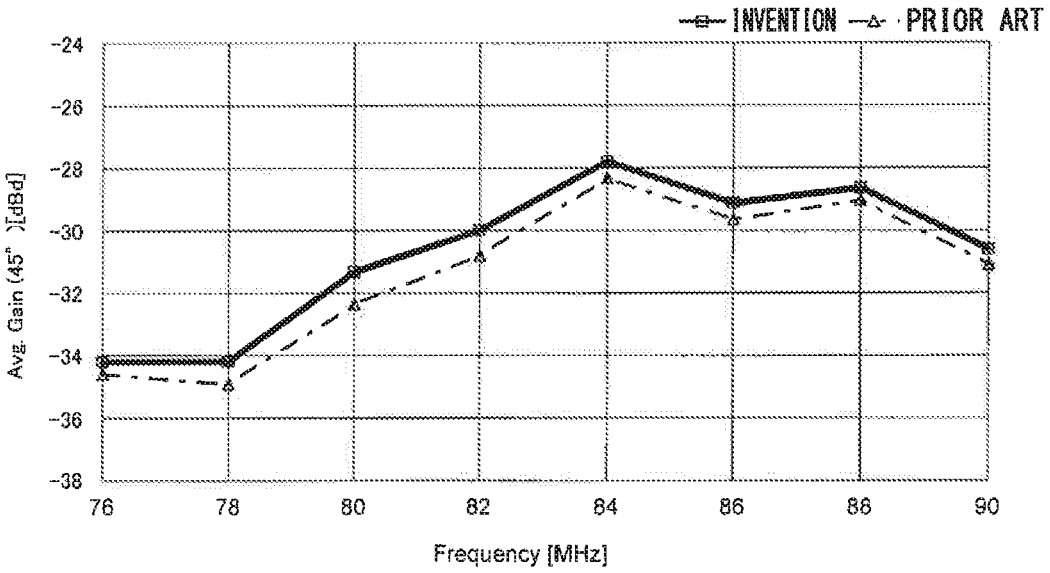
FIG. 40 is a graph showing frequency characteristics of average gain of an antenna device of the present invention and of a conventional antenna device.
Figure 41:
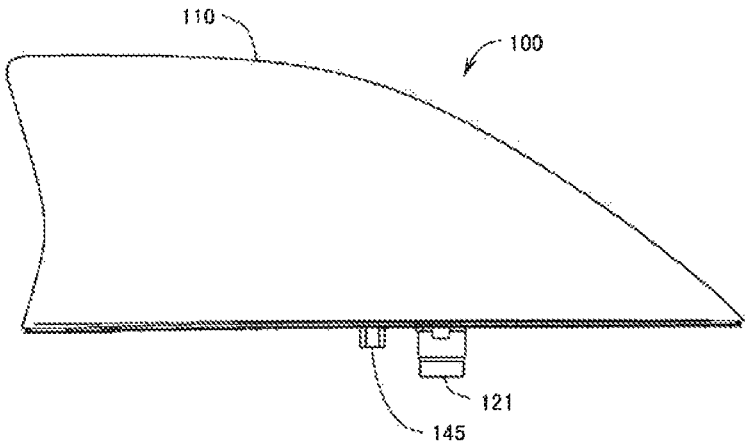
FIG. 41 is a side view showing the configuration of a conventional antenna device.
Figure 42:
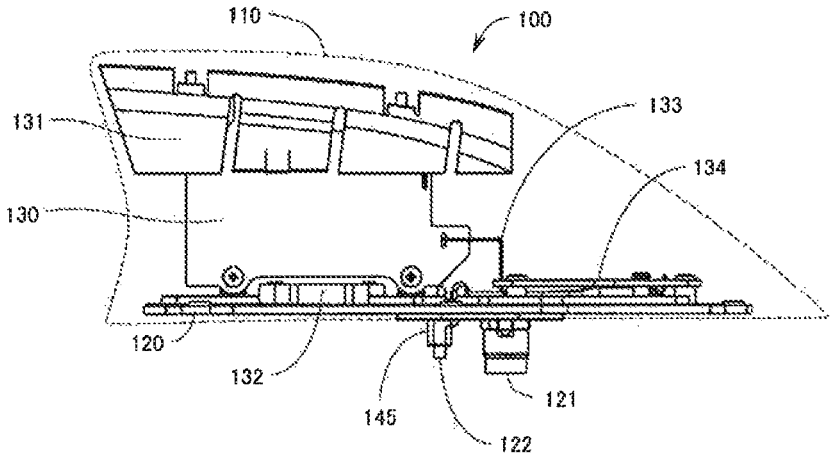
FIG. 42 is a side view showing the internal configuration of a conventional antenna device.
Figure 43:
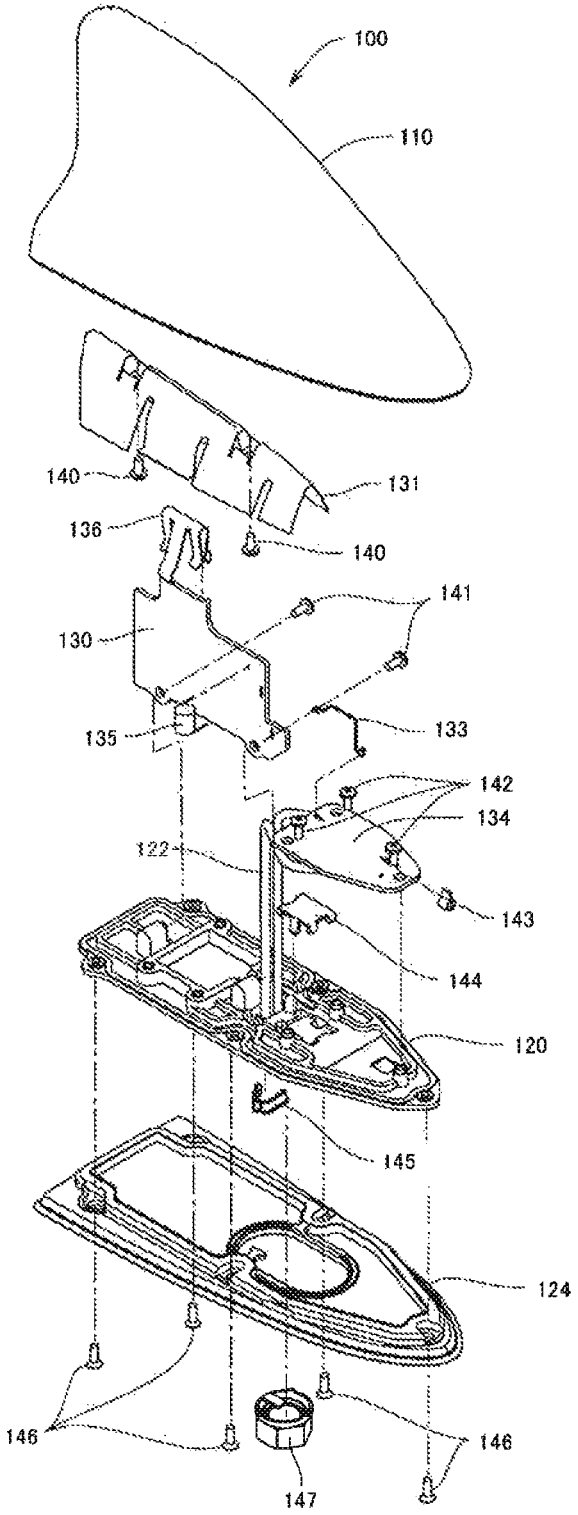
FIG. 43 is an exploded view showing the configuration of a conventional antenna device.
Figure 44:
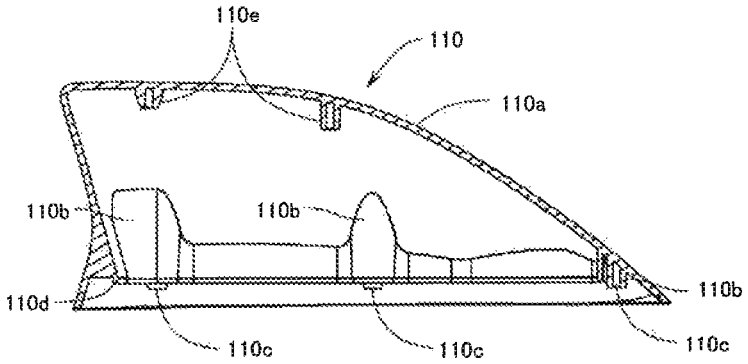
FIG. 44 is a side view showing, in cross section, the configuration of an antenna case of a conventional antenna device.
Figure 45:
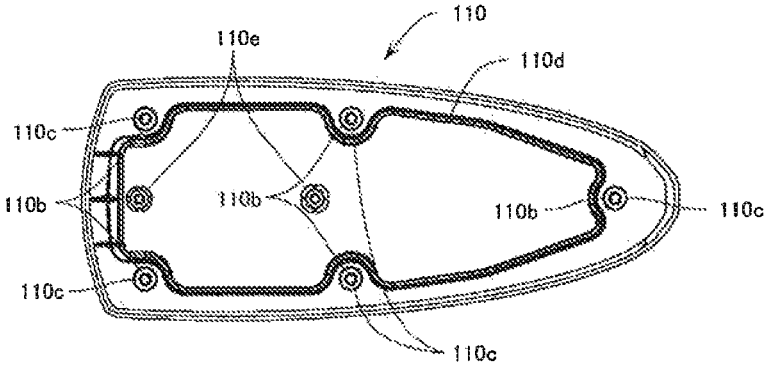
FIG. 45 is a bottom view showing the configuration of an antenna case of a conventional antenna device.
Figure 46:
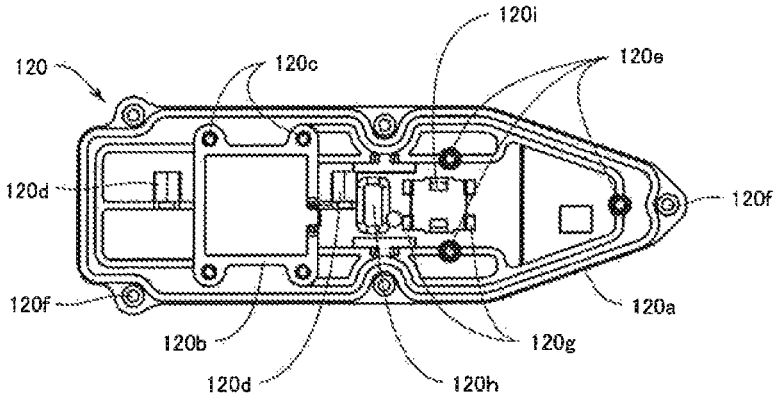
FIG. 46 is a top view showing the configuration of an antenna base of a conventional antenna device.
Figure 47:
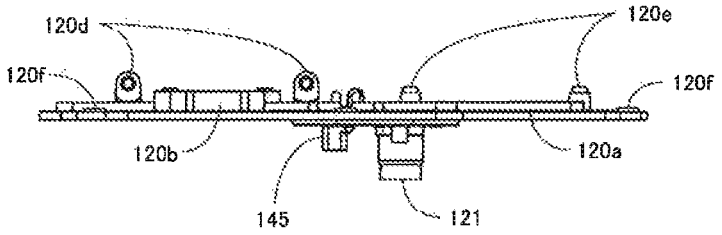
FIG. 47 is a side view showing the configuration of an antenna base of a conventional antenna device.
Figure 48:
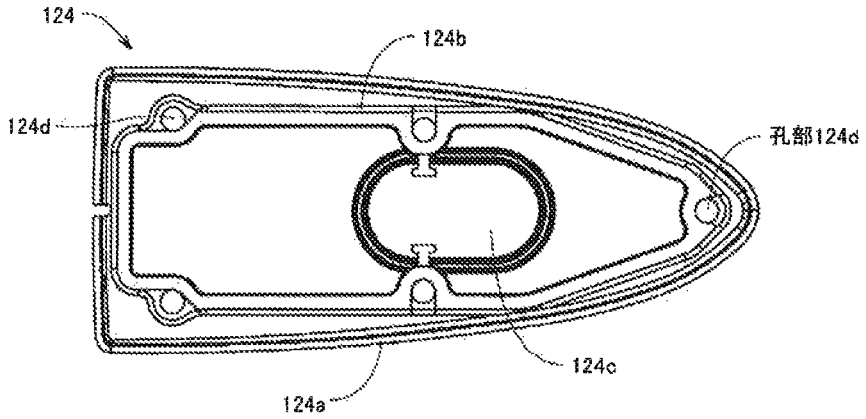
FIG. 48 is a top view showing the configuration of a base pad of a conventional antenna device.
Figure 49:
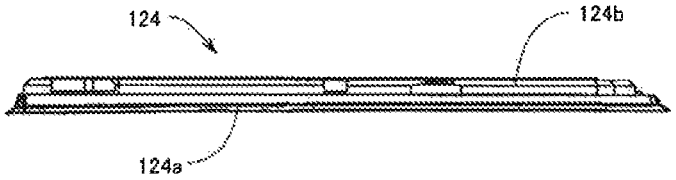
FIG. 49 is a side view showing the configuration of a base pad of a conventional antenna device.

FIG. 40 shows frequency characteristics of average gain of the antenna device 1 of the present invention relative to frequency characteristics of average gain of the conventional antenna device. Incidentally the average gain is average gain with an elevation angle of 45 degrees.

The antenna device 1 of the present invention is about 66 mm in height, about 63 mm in width, and about 151 mm in length; the conventional antenna device is about 66 mm in height, about 63 mm in width, and about 153 mm in length. Both the antenna devices are substantially equal in size. With reference to FIG. 40, in the antenna device 1 of the present invention, the maximum gain is about −28 dBd at a frequency of about 84 MHz; in the frequency range of 76 MHz to 90 MHz, the average gain is about −34 dBd or more. In the case of the conventional antenna device, the maximum gain is about −28.5 dBd at a frequency of about 84 MHz; in the frequency range of 76 MHz to 90 MHz, the average gain is about −35 dBd or more. It is clear that, across the entire frequency range of 76 MHz to 90 MHz, there is an improvement in the gain of the antenna device 1 of the present invention.

INDUSTRIAL APPLICABILITY

In the antenna device 1 of the present invention described above, a temporary-fixing hook for temporary fixing on which a pair of long engagement leg sections is stretched from both sides may be inserted into a through-hole of the bolt section 21*a* of the conductive base 21. When the antenna device 1 is attached to the vehicle, the engagement leg sections engage with an edge of a mounting hole that is formed in the vehicle, thereby working to temporarily fix the antenna device 1 to the vehicle body. Incidentally, when the hook is inserted into the through-hole, a cable cannot be led out through the through-hole. However, through a cable pull-out port that is formed behind the through-hole, a cable connected to the amplifier can be led out.

EXPLANATION OF REFERENCE SYMBOLS

1: Antenna device
2: Antenna assembly
10: Antenna case
10*a*: Outer shell section
10*b*: Outer peripheral wall section
10*c*: Inner peripheral wall section
11: Antenna base
12: Element holder
12*a*: Frame section
12*b*: Leg section
12*c*: Holding section
12*d*: Holding section
12*e*: Engagement claw
12*f*: Coil retaining piece
12*g*: Lead-out groove
12*h*: Engagement projection
12*i*: Terminal retaining piece
12*j*: Insertion hole
12*k*: Terminal retaining section
13: Umbrella-type element
13*a*: Apex section
13*b*: Inclined section
13*c*: Inclined section
13*d*: Slit
13*e*: Back surface section
13*f*: Folded section
13*g*: Terminal
14: Coil
14*a*: Coil main body
14*b*: Lead
15: Power supply terminal
15*a*: Planar section
15*b*: Bent section
15*c*: Lead-out section
15*d*: Terminal strip
16: Amplifier substrate
16*a*: Substrate main body
16*b*: Insertion hole
16*c*: Connection hole
17: Ring-shaped seal
18: Gap cover
18*a*: Groove section
18*b*: Cut section
20: Insulation base
20*a*: Main body section
20*b*: Flange section
20*c*: Peripheral wall section
20*d*: Engagement boss section
20*e*: Engagement piece
20*f*: Central cut-out section
20*g*: Engagement projection
20*h*: Annular groove
20*i*: Pressing piece
20*j*: Housing section
21: Conductive base

21*a*: Bolt section
21*b*: Main body section
21*d*: Engagement hole
21*e*: Insertion hole
21*f*: Engagement hole
21*g*: First boss
21*h*: Second boss
21*i*: Notch
21*j*: Upright installation piece
100: Antenna device
110: Antenna case
110*a*: Outer shell section
110*b*: Boss
110*c*: Screw hole
110*d*: Peripheral wall section
110*e*: Boss
120: Antenna base
120*a*: Main body section
120*b*: Antenna mounting section
120*c*: Screw hole
120*d*: Screw section
120*e*: Boss
120*f*: Fitting hole
120*g*: First rectangular hole
120*h*: Cable pull-out hole
120*i*: Second rectangular hole
121: Bolt section
122: Cable
124: Base pad
124*a*: Main body section
124*b*: Peripheral wall section
124*c*: Cut-out hole
124*d*: Hole section
130: Antenna substrate
131: Top section
132: Antenna
133: Connection line
134: Amplifier substrate
135: Coil
136: Joint fitting
140: Screw
141: Screw
142: Screw
143: Terminal
144: Hook
144*b*: Fitting leg section
144*c*: Engagement leg section
145: Collar
146: Screw
147: Nut

The invention claimed is:

1. An antenna device, characterized by comprising:

an insulating antenna case that lower surface is open and in which a housing space is formed;

an antenna base that includes an insulation base on which the antenna case is fitted, and a conductive base which is smaller than the insulation base and is fixed onto the insulation base;

an insulating element holder that is installed upright and provided on the antenna base;

an umbrella-type element that is fixed to an upper section of the element holder in such a way that a rear section thereof is located above the insulation base;

an amplifier substrate that includes an amplifier which amplifies a signal received by the umbrella-type element, and is disposed on the conductive base and fixed to the antenna base; and a coil that is inserted between an output end of the umbrella-type element and an input end of the amplifier to make the umbrella-type element resonate at a predetermined frequency, wherein, when the antenna case is fitted onto the insulation base, a lower surface of the antenna case is welded or bonded to the insulation base to make a waterproof structure.

2. The antenna device according to claim 1, wherein:

a groove section that is formed in a string-like gap cover is fitted onto a flange section that is formed on an outer periphery of the insulation base, and the gap cover is therefore wound around the insulation base; and in a lower section of the antenna case, an inner peripheral wall section which includes a lower surface that is welded or bonded to the conductive base, and an outer peripheral wall section that inner periphery abuts against an outer periphery of the insulation base around which the gap cover is wound, are formed.

3. The antenna device according to claim 1, wherein:

an engagement piece is formed on the insulation base in such a way as to be substantially parallel to a long axis; a upright installation piece with which the engagement piece engages is formed on the conductive base in such a way as to be substantially parallel to a long axis; and, when the conductive base is fixed onto the insulation base as the engagement piece engages with the upright installation piece, the conductive base can expand and contract in a long-axis direction with respect to the insulation base.

4. The antenna device according to claim 1, wherein the element holder includes a frame-like frame section, and the coil is fixed to an inner side of the frame section.

5. The antenna device according to claim 1, wherein:

on the antenna base, a bolt section that is so formed as to protrude from a lower surface of the conductive base passes through the insulation base and protrudes from a lower surface thereof; and, into a groove section that is formed on a lower surface of the insulation base in such a way as to surround the bolt section, a ring-shaped seal is inserted.

* * * * *